US010458008B2

(12) United States Patent
Na et al.

(10) Patent No.: US 10,458,008 B2
(45) Date of Patent: Oct. 29, 2019

(54) ZIRCONIUM-COBALT-NICKEL-ALUMINUM GLASSES WITH HIGH GLASS FORMING ABILITY AND HIGH REFLECTIVITY

(71) Applicant: GlassiMetal Technology, Inc., Pasadena, CA (US)

(72) Inventors: Jong Hyun Na, Pasadena, CA (US); Kyung-Hee Han, Pasadena, CA (US); Glenn Garrett, Pasadena, CA (US); Maximilien Launey, Pasadena, CA (US); Marios D. Demetriou, West Hollywood, CA (US); William L. Johnson, San Marino, CA (US)

(73) Assignee: GlassiMetal Technology, Inc., Pasadena, CA (US)

( * ) Notice: Subject to any disclaimer, the term of this patent is extended or adjusted under 35 U.S.C. 154(b) by 0 days.

(21) Appl. No.: 15/960,455

(22) Filed: Apr. 23, 2018

(65) Prior Publication Data

US 2018/0312949 A1 Nov. 1, 2018

Related U.S. Application Data

(60) Provisional application No. 62/490,842, filed on Apr. 27, 2017.

(51) Int. Cl.
*C22C 45/10* (2006.01)
*C22F 1/18* (2006.01)

(52) U.S. Cl.
CPC ..... *C22C 45/10* (2013.01); *C22F 1/186* (2013.01); *C22C 2200/02* (2013.01)

(58) Field of Classification Search
CPC ..... C22C 45/10; C22C 2200/02; C22F 1/186
(Continued)

(56) References Cited

U.S. PATENT DOCUMENTS 3,809,547 A 5/1974 Lewis et al.
3,856,513 A 12/1974 Chen et al.
(Continued)

FOREIGN PATENT DOCUMENTS

CN 1354274 A 6/2002
CN 1653200 A 8/2005
(Continued)

OTHER PUBLICATIONS

Burke, "The Corrosion of Metals in Tissues; and an Introduction to Tantalum", The Canadian Medical Association Journal, Aug. 1940, pp. 125-128.
(Continued)

*Primary Examiner* — Brian D Walck
(74) *Attorney, Agent, or Firm* — KPPB LLP

(57) ABSTRACT

The disclosure is directed to Zr—Co—Ni—Al alloys that optionally comprise Ti and are capable of forming metallic glasses having a combination of high glass forming ability and high reflectivity. Compositional regions in the Zr—Co—Ni—Al and Zr—Ti—Co—Ni—Al alloys are disclosed where the metallic glass-forming alloys demonstrate a high glass forming ability while the metallic glasses formed from the alloys exhibit a high reflectivity. The metallic glass-forming alloys demonstrate a critical plate thickness of at least 2 mm, while the metallic glasses formed from the alloys demonstrate a CIELAB L* value of at least 78.

19 Claims, 22 Drawing Sheets

(58) Field of Classification Search
USPC ..... 148/403
See application file for complete search history.

(56) References Cited

U.S. PATENT DOCUMENTS

| | | | |
|---|---|---|---|
| 4,050,931 | A | 9/1977 | Tanner et al. |
| 4,116,682 | A | 9/1978 | Polk et al. |
| 4,126,284 | A | 11/1978 | Ichikawa et al. |
| 4,144,058 | A | 3/1979 | Chen et al. |
| 4,152,144 | A | 5/1979 | Hasegawa et al. |
| 4,175,950 | A | 11/1979 | Linares et al. |
| 4,385,932 | A | 5/1983 | Inomata et al. |
| 4,385,944 | A | 5/1983 | Hasegawa |
| 4,582,536 | A | 4/1986 | Raybould |
| 4,892,628 | A | 1/1990 | Guilinger |
| 4,900,638 | A | 2/1990 | Emmerich |
| 4,968,363 | A | 11/1990 | Hashimoto et al. |
| 5,288,344 | A | 2/1994 | Peker et al. |
| 5,338,376 | A | 8/1994 | Liu et al. |
| 5,429,725 | A | 7/1995 | Thorpe et al. |
| 5,634,989 | A | 6/1997 | Hashimoto et al. |
| 5,797,443 | A | 8/1998 | Lin et al. |
| 6,004,661 | A | 12/1999 | Sakai et al. |
| 6,039,860 | A | 3/2000 | Cooper et al. |
| 6,303,015 | B1 | 10/2001 | Thorpe et al. |
| 6,325,868 | B1 | 12/2001 | Kim et al. |
| 6,638,369 | B1 | 10/2003 | Tucker et al. |
| 6,695,936 | B2 | 2/2004 | Johnson |
| 7,008,490 | B2 | 3/2006 | Peker |
| 8,052,923 | B2 | 11/2011 | Langlet |
| 8,287,664 | B2 | 10/2012 | Brunner |
| 8,529,712 | B2 | 9/2013 | Demetriou et al. |
| 8,911,572 | B2 | 12/2014 | Kim et al. |
| 9,085,814 | B2 | 7/2015 | Na et al. |
| 9,534,283 | B2 | 1/2017 | Na et al. |
| 9,556,504 | B2 | 1/2017 | Na et al. |
| 9,828,659 | B2 | 11/2017 | Na et al. |
| 9,863,024 | B2 | 1/2018 | Na et al. |
| 9,920,410 | B2 | 3/2018 | Na et al. |
| 9,957,596 | B2 | 5/2018 | Na et al. |
| 10,000,834 | B2 | 6/2018 | Na et al. |
| 2005/0263216 | A1 | 12/2005 | Chin et al. |
| 2006/0157164 | A1 | 7/2006 | Johnson et al. |
| 2006/0213586 | A1 | 9/2006 | Kui |
| 2006/0231169 | A1 | 10/2006 | Park et al. |
| 2007/0048164 | A1* | 3/2007 | Demetriou ..... B22F 3/1125 419/2 |
| 2007/0175545 | A1 | 8/2007 | Urata et al. |
| 2009/0014096 | A1 | 1/2009 | Wiest et al. |
| 2009/0101244 | A1* | 4/2009 | Ogawa ..... A01K 83/00 148/538 |
| 2009/0110955 | A1 | 4/2009 | Hartmann et al. |
| 2009/0114317 | A1* | 5/2009 | Collier ..... C22C 45/00 148/538 |
| 2010/0089761 | A1 | 4/2010 | Wang et al. |
| 2010/0230012 | A1 | 9/2010 | Demetriou et al. |
| 2012/0073710 | A1 | 3/2012 | Kim et al. |
| 2012/0168037 | A1 | 7/2012 | Demetriou et al. |
| 2013/0048152 | A1 | 2/2013 | Na et al. |
| 2013/0263973 | A1 | 10/2013 | Kurahashi et al. |
| 2014/0076467 | A1 | 3/2014 | Na et al. |
| 2014/0096873 | A1 | 4/2014 | Na et al. |
| 2014/0096874 | A1 | 4/2014 | Weber |
| 2014/0116579 | A1 | 5/2014 | Na et al. |
| 2014/0130942 | A1 | 5/2014 | Floyd et al. |
| 2014/0130945 | A1 | 5/2014 | Na et al. |
| 2014/0190593 | A1 | 7/2014 | Na et al. |
| 2014/0202596 | A1 | 7/2014 | Na et al. |
| 2014/0213384 | A1 | 7/2014 | Johnson et al. |
| 2014/0238551 | A1 | 8/2014 | Na et al. |
| 2014/0345755 | A9 | 11/2014 | Na et al. |
| 2015/0047755 | A1 | 2/2015 | Na et al. |
| 2015/0050181 | A1 | 2/2015 | Na et al. |
| 2015/0096652 | A9 | 4/2015 | Na et al. |
| 2015/0158126 | A1 | 6/2015 | Hartmann et al. |
| 2015/0159242 | A1 | 6/2015 | Na et al. |
| 2015/0159248 | A1 | 6/2015 | Na et al. |
| 2015/0176111 | A1 | 6/2015 | Na et al. |
| 2015/0197837 | A9 | 7/2015 | Schramm et al. |
| 2015/0240336 | A1 | 8/2015 | Na et al. |
| 2016/0047023 | A1 | 2/2016 | Na et al. |
| 2016/0060739 | A1 | 3/2016 | Na et al. |
| 2016/0090644 | A1 | 3/2016 | Na et al. |
| 2016/0090944 | A1 | 3/2016 | Takahashi et al. |
| 2017/0088933 | A1 | 3/2017 | Launey et al. |
| 2017/0152588 | A9 | 6/2017 | Na et al. |

FOREIGN PATENT DOCUMENTS

| | | | |
|---|---|---|---|
| CN | 101787525 | A | 7/2010 |
| CN | 103917673 | A | 7/2014 |
| CN | 104822852 | A | 8/2015 |
| CN | 104822852 | B | 12/2017 |
| DE | 3608656 | A1 | 9/1986 |
| DE | 3929222 | A1 | 3/1991 |
| DE | 102011001783 | A1 | 10/2012 |
| DE | 102011001784 | A1 | 10/2012 |
| DE | 112013005202 | T5 | 8/2015 |
| EP | 0014335 | A1 | 8/1980 |
| EP | 0161363 | A2 | 11/1985 |
| EP | 0161393 | A1 | 11/1985 |
| EP | 0260706 | A1 | 3/1988 |
| EP | 1077272 | A1 | 2/2001 |
| EP | 1108796 | A1 | 6/2001 |
| EP | 1522602 | A1 | 4/2005 |
| EP | 2748345 | B1 | 8/2018 |
| JP | S5476423 | A | 6/1979 |
| JP | S55148752 | A | 11/1980 |
| JP | S5713146 | | 1/1982 |
| JP | 60024346 | A | 2/1985 |
| JP | 63079930 | A | 4/1988 |
| JP | 63079931 | A | 4/1988 |
| JP | S63277734 | A | 11/1988 |
| JP | H01205062 | A | 8/1989 |
| JP | 08269647 | | 10/1996 |
| JP | H09143642 | A | 6/1997 |
| JP | H1171659 | A | 3/1999 |
| JP | 2001049407 | A | 2/2001 |
| JP | 2007075867 | A | 3/2007 |
| JP | 2014132116 | A | 7/2014 |
| JP | 2014529013 | A | 10/2014 |
| JP | 2016502597 | A | 1/2016 |
| JP | 6302477 | B2 | 3/2018 |
| WO | 2012053570 | A1 | 4/2012 |
| WO | 2013028790 | A2 | 2/2013 |
| WO | 2013028790 | A3 | 6/2013 |
| WO | 2014043722 | A2 | 3/2014 |
| WO | 2014058893 | A1 | 4/2014 |
| WO | 2014070898 | A1 | 5/2014 |
| WO | 2014078697 | A2 | 5/2014 |
| WO | 2014078697 | A3 | 5/2015 |

OTHER PUBLICATIONS

Geurtsen, "Biocompatibility of Dental Casting Alloys", Crit. Rev. Oral Biol. Med., 2002, vol. 13, No. 1, pp. 71-84.

Greer et al., "Bulk Metallic Glasses: At the Cutting Edge of Metals Research", MRS Bulletin, Aug. 2007, vol. 32, pp. 611-619.

Hiromoto et al., "Effect of chloride ion on the anodic polarization behavior of the Zr65A17.5Ni10Cu17.5 amorphous alloy in phosphate buffered solution", Corrosion Science, 2000, vol. 42, pp. 1651-1660.

Hiromoto et al., "Effect of pH on the polarization behavior of Zr65AI7.5Ni10Cu17.5 amorphous alloy in a phosphate-buffered solution", Corrosion Science, 2000, vol. 42, pp. 2193-2200.

Inoue, "Stabilization of Metallic Supercooled Liquid and Bulk Amorphous Alloys", Acta Materialia, 2000, vol. 48, pp. 279-306.

Inoue et al., "Preparation of Bulky Amorphous Zr—Al—Co—Ni—Cu Alloys by Copper Mold Casting and Their Thermal and Mechanical Properties", Materials Transactions, JIM, 1995, vol. 36, No. 3, pp. 391-398.

(56) References Cited

OTHER PUBLICATIONS

Johnson, "Bulk Glass-Forming Metallic Alloys: Science and Technology", MRS Bulletin, Oct. 1999, pp. 42-56.
Li et al., "Effects of Cu, Fe, and Cu Addition on the Glass Forming Ability and Mechanical Properties of Zr—Al—Ni Bulk Metallic Glasses", Science China, Physics, Mechanics & Astronomy, Dec. 2012, vol. 55, No. 12, pp. 2367-2371.
Morrison et al., "Cyclic-anodic-polarization studies of a Zr41.2Ti13.8Ni10Cu12.5Be22.5 bulk metallic glass", Intermetallics, 2004, vol. 12, pp. 1177-1181.
Peker et al., "A highly processible metallic glass: Zr41.2Ti13.8Cu12.5Ni10.0Be22.5", Applied Physics Letters, Oct. 25, 1993, vol. 63, No. 17, pp. 2342-2344.
Schroers, "The Superplastic Forming of Bulk Metallic Glasses", JOM, May 2005, pp. 35-39.
Wang et al., "Fatigue behavior and fracture morphology of Zr50AI10Cu40 and Zr50AI10Cu30Ni10 bulk-metallic glasses", Intermetallics, 2004, vol. 12, pp. 1219-1227.
Yamamoto et al., "Cytotoxicity evaluation of 43 metal salts using murine fibroblasts and osteoblastic cells", Journal of Biomed. Materials Research, 1998, vol. 39, 331-340.
International Preliminary Report on Patentability for International Application PCT/US2013/070370, Issued May 19, 2015, dated May 28, 2015, 9 pages.
International Preliminary Report on Patentability for International Application PCT/US2012/051921, issued Feb. 25, 2014, dated Mar. 6, 2014, 8 Pgs.
International Preliminary Report on Patentability for International Application PCT/US2013/060226, issued Mar. 17, 2015, dated Mar. 26, 2015, 9 Pgs.
International Preliminary Report on Patentability for International Application No. PCT/US2013/063902, issued Apr. 8, 2015, dated Apr. 16, 2015, 12 Pgs.
International Preliminary Report on Patentability for International Application PCT/US2013/067519, issued May 5, 2015, dated May 14, 2015, 9 Pgs.
International Search Report and Written Opinion for International Application PCT/US2012/051921, completed Jan. 3, 2013, dated Apr. 16, 2013, 10 pgs.
International Search Report and Written Opinion for Application PCT/US2013/070370, completed Mar. 30, 2015, dated Apr. 13, 2015, 12 pgs.
International Search Report and Written Opinion for International Application No. PCT/US2013/060226, completed Dec. 5, 2013, dated Jun. 11, 2014, 14 pgs.
International Search Report and Written Opinion for International Application No. PCT/US2013/063902, completed Nov. 29, 2013, dated Feb. 14, 2014, 18 pgs.
International Search Report and Written Opinion for International Application PCT/US2013/067519, completed Dec. 6, 2013, dated Dec. 18, 2013, 13 pgs.
Abrosimova et al., "Phase segregation and crystallization in the amorphous alloy $Ni_{70}$ $Mo_{10}$ $P_{20}$ ", Physics of the Solid State, 1998, vol. 40., No. 9, pp. 1429-1432.
Debold et al., "How to Passivate Stainless Steel Parts", Modern Machine Shop, Oct. 1, 2003, 10 pgs.
Duan et al., "Thermal and elastic properties of Cu—Zr—Be bulk metallic glass forming alloys", Applied Physics Letters, 2007, vol. 90, pp. 211901-1-211901-3, doi: 10.1063/1.2741050.
Hartmann et al., "New Amorphous Brazing Foils for Exhaust Gas Application", Proceedings of the 4th International Brazing and Soldering Conference, Apr. 26-29, 2009, Orlando, Florida, USA.
Katagiri et al., "An attempt at preparation of corrosion-resistant bulk amorphous Ni—Cr—Ta—Mo—P—B alloys", Corrosion Science, Jan. 2001, vol. 43, No. 1, pp. 183-191, doi: 10.1016/S0010-938X(00)00068-8.
Laws et al., "Electron-band theory inspired design of magnesium—precious metal bulk metallic glasses with high thermal stability and extended ductility", Scientific Reports, Jun. 13, 2017, vol. 7, No. 3400, 11 pgs., doi: 10.1038/s41598-017-03643-7.
Murakami, "Stress Intensity Factors Handbook", Oxford: Pergamon Press, 1987, vol. 2, 4 pgs.
Murakami, "Stress Intensity Factors Handbook", vol. 2. Oxford (United Kingdom): Pergamon Press; 1987, 11 pgs., p. 666 in particular.
Park et al., Development of new Ni-based amorphous alloys containing no metalloid that have large undercooled liquid regions-Scripta Materialia, 2000, vol. 43, No. 2, pp. 109-114.
Rabinkin et al., "Brazing Stainless Steel Using New MBF-Series of Ni—Cr—B—Si Amorphous Brazing Foils New Brazing Alloys Withstand High-Temperature and Corrosive Environments", Welding Research Supplement, Feb. 1998, pp. 66-75.
Shamlaye et al., "Exceptionally broad bulk metallic glass formation in the Mg—Cu—Yb system", Acta Materialia, Apr. 15, 2017, vol. 128, pp. 188-196, doi: 10.1016/j.actamat.2017.02.013.
Sunderman, "Potential toxicity from nickel contamination of intravenous fluids", Annals of Clinical & Laboratory Science, 1983, vol. 13, pp. 1-4.
Yokoyama et al., "Hot-press workability of Ni-based glassy alloys in supercooled liquid state and production of the glassy alloy separators for proton exchange membrane fuel cell", Journal of the Japan Society of Powder and Powder Metallurgy, 2007, vol. 54, No. 11, pp. 773-777.
Yokoyama et al., "Viscous Flow Workability of Ni—Cr—P—B Metallic Glasses Produced by Melt-Spinning in Air", The Japan Institute of Metals Materials Transactions, Nov. 2007 vol. 48, No. 12, pp. 3176-3180.

* cited by examiner

ZIRCONIUM-COBALT-NICKEL-ALUMINUM GLASSES WITH HIGH GLASS FORMING ABILITY AND HIGH REFLECTIVITY

CROSS-REFERENCE TO RELATED APPLICATIONS

The present application claims priority to U.S. Provisional Application No. 62/490,842 filed Apr. 27, 2017, entitled Zirconium-Cobalt-Nickel-Aluminum Glasses with High Glass Forming Ability and High Reflectivity, the disclosure of which is incorporated herein by reference in its entirety.

FIELD OF THE INVENTION

The disclosure is directed to Zr—Co—Ni—Al alloys that optionally comprise Ti and are capable of forming metallic glasses having a combination of high glass forming ability and high reflectivity.

BACKGROUND OF THE INVENTION

Inoue et al. (A. Inoue, T. Zhang, T. Masumoto "Preparation of Bulky Amorphous Zr—Al—Co—Ni—Cu Alloys by Copper Mold Casting and Their Thermal and Mechanical Properties," Materials Transactions JIM 36(3), 391-398 (1995)), the disclosure of which is incorporated herein by reference in its entirety, discloses Zr—Co—Ni—Al metallic glass-forming alloy systems with compositions (subscripts denote atomic percentages) $Zr_{60}Al_{10}(Co—Ni)_{30}$, $Zr_{60}Al_{15}(Co—Ni)_{25}$, and $Zr_{55}Al_{20}(Co—Ni)_{25}$. The disclosure teaches that bulk glass formation (i.e. where a glass part having cross section thickness in excess of 1 mm can be formed) is not possible in the $Zr_{60}Al_{10}(Co—Ni)_{30}$ system, and is possible in the $Zr_{60}Al_{15}(Co—Ni)_{25}$ and $Zr_{55}Al_{20}(Co—Ni)_{25}$ systems only when the Co atomic fraction is less than 10 percent.

Li et al. (Y. H. Li, W. Zhang, C. Dong, A. Makino "Effects of Cu, Fe, and Cu Addition on the Glass Forming Ability and Mechanical Properties of Zr—Al—Ni Bulk Metallic Glasses," Science China 55(12), 2367-2371 (2012)), the disclosure of which is incorporated herein by reference in its entirety, discloses Zr—Co—Ni—Al metallic glass-forming alloys with composition (subscripts denote atomic percentages) $Zr_{60}Co_xNi_{25-x}Al_{15}Ti_4$, where the atomic concentration of Co, x, ranges from 0 to 10%. The disclosure reports that the alloys are capable of forming ribbons with thickness of 20 micrometers. The critical rod diameter of the alloys is not reported, however, it is noted to be less than 15 mm.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

BRIEF SUMMARY

Figure 1:
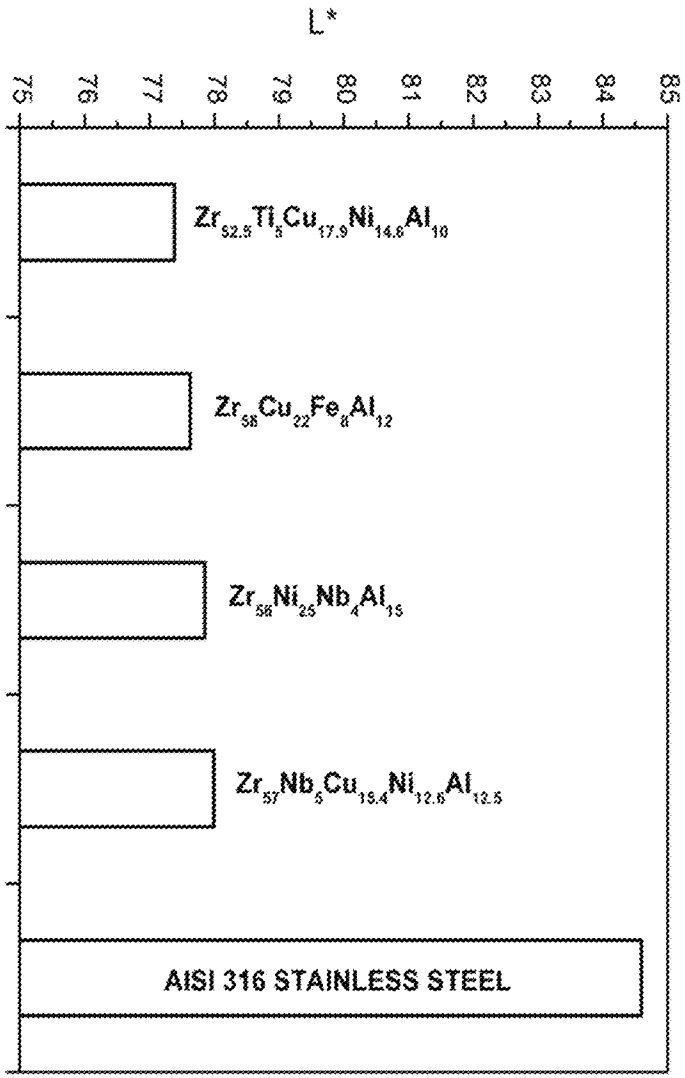
FIG. 1 presents a bar plot comparing the CIELAB L* values of various known Zr-based metallic glasses against that of AISI 316 stainless steel.

The disclosure provides Zr—Co—Ni—Al metallic glass-forming alloys and metallic glasses that optionally bear Ti and have a high glass forming ability along with a high reflectivity.

In many embodiments, the disclosure provides an alloy capable of forming a metallic glass having a composition represented by the following formula (subscripts denote atomic percentages):

$$Zr_{(100-a-b-c-d)}Ti_aCo_bNi_cAl_d$$

where:

a is up to 10;

b ranges from 12 to 22;

c ranges from 8 to 20; and d ranges from 8 to 18, wherein the critical plate thickness of the alloy is at least 2 mm, and wherein the CIELAB L* value of the metallic glass is at least 78.

In other embodiments related to those above or disclosed elsewhere herein, the critical plate thickness of the alloy is at least 3 mm.

In other embodiments related to those above or disclosed elsewhere herein, the critical plate thickness of the alloy is at least 4 mm.

In other embodiments related to those above or disclosed elsewhere herein, the critical plate thickness of the alloy is at least 5 mm.

In other embodiments related to those above or disclosed elsewhere herein, the CIELAB L* value of the metallic glass is at least 78.2.

In other embodiments related to those above or disclosed elsewhere herein, the CIELAB L* value of the metallic glass is at least 78.4.

In other embodiments related to those above or disclosed elsewhere herein, the CIELAB b* value of the metallic glass is equal to or less than 3.5.

In other embodiments related to those above or disclosed elsewhere herein, the CIELAB b* value of the metallic glass is equal to or less than 3.25.

In other embodiments related to those above or disclosed elsewhere herein, the CIELAB b* value of the metallic glass is equal to or less than 3.

In other embodiments related to those above or disclosed elsewhere herein, the notch toughness of the metallic glass is at least 70 MPa $m^{1/2}$.

In other embodiments related to those above or disclosed elsewhere herein, the notch toughness of the metallic glass is at least 80 MPa $m^{1/2}$.

In other embodiments related to those above or disclosed elsewhere herein, the notch toughness of the metallic glass is at least 90 MPa $m^{1/2}$.

In other embodiments related to those above or disclosed elsewhere herein, a ranges from 0.1 to 10.

In other embodiments related to those above or disclosed elsewhere herein, a ranges from 0.1 to 10, and the critical plate thickness is at least 3 mm.

In other embodiments related to those above or disclosed elsewhere herein, a ranges from 0.25 to 10.

In other embodiments related to those above or disclosed elsewhere herein, a ranges from 0.25 to 10, and the critical plate thickness of the alloy is at least 3 mm.

In other embodiments related to those above or disclosed elsewhere herein, a ranges from 0.5 to 10.

In other embodiments related to those above or disclosed elsewhere herein, a ranges from 0.5 to 10, and the critical plate thickness of the alloy is at least 3 mm.

In other embodiments related to those above or disclosed elsewhere herein, a ranges from 0.5 to 8.

In other embodiments related to those above or disclosed elsewhere herein, a ranges from 0.5 to 8, and the critical plate thickness of the alloy is at least 3 mm.

In other embodiments related to those above or disclosed elsewhere herein, a ranges from 1 to 7.

In other embodiments related to those above or disclosed elsewhere herein, a ranges from 1 to 7, and the critical plate thickness of the alloy is at least 4 mm.

In other embodiments related to those above or disclosed elsewhere herein, a ranges from 2 to 6.

In other embodiments related to those above or disclosed elsewhere herein, a ranges from 2 to 6, and the critical plate thickness of the alloy is at least 5 mm.

In other embodiments related to those above or disclosed elsewhere herein, b ranges from greater than 12 to less than 22.

In other embodiments related to those above or disclosed elsewhere herein, b ranges from 12.5 to 21.5.

In other embodiments related to those above or disclosed elsewhere herein, b ranges from 13 to 21.

In other embodiments related to those above or disclosed elsewhere herein, b ranges from 13.5 to 20.5.

In other embodiments related to those above or disclosed elsewhere herein, b ranges from 14 to 20.

In other embodiments related to those above or disclosed elsewhere herein, b ranges from 14 to 20, and the CIERLAB L* value of the metallic glass is at least 78.2.

In other embodiments related to those above or disclosed elsewhere herein, c ranges from greater than 8 to less than 20.

In other embodiments related to those above or disclosed elsewhere herein, c ranges from 8.5 to 19.5.

In other embodiments related to those above or disclosed elsewhere herein, c ranges from 9 to 18.5.

In other embodiments related to those above or disclosed elsewhere herein, c ranges from 9 to 18.5, and the CIELAB b* value of the metallic glass is less than 3.5.

In other embodiments related to those above or disclosed elsewhere herein, c ranges from 9.5 to 18.

In other embodiments related to those above or disclosed elsewhere herein, c ranges from 9.5 to 18, and the CIELAB L* value of the metallic glass is greater than 78.

In other embodiments related to those above or disclosed elsewhere herein, c ranges from 9.5 to 18, and the CIELAB b* value of the metallic glass is less than 3.25.

In other embodiments related to those above or disclosed elsewhere herein, c ranges from 9.75 to 17.75.

In other embodiments related to those above or disclosed elsewhere herein, c ranges from 10.25 to 17.25.

In other embodiments related to those above or disclosed elsewhere herein, c ranges from 10.25 to 17.25, and the critical plate thickness of the alloy is greater than 2 mm.

In other embodiments related to those above or disclosed elsewhere herein, c ranges from 10.25 to 17.25, and the CIELAB b* value of the metallic glass is less than 3.2.

In other embodiments related to those above or disclosed elsewhere herein, c ranges from 10.25 to 14.75.

In other embodiments related to those above or disclosed elsewhere herein, c ranges from 10.25 to 14.75, and the CIELAB L* value of the metallic glass is greater than 78.2.

In other embodiments related to those above or disclosed elsewhere herein, d ranges from greater than 8 to less than 18.

In other embodiments related to those above or disclosed elsewhere herein, d ranges from 9 to 17.75.

In other embodiments related to those above or disclosed elsewhere herein, d ranges from 10 to 17.5.

In other embodiments related to those above or disclosed elsewhere herein, d ranges from greater than 10 to less than 17.5.

In other embodiments related to those above or disclosed elsewhere herein, d ranges from greater than 10 to less than 17.5, and the critical plate thickness of the alloy is greater than 2 mm.

In other embodiments related to those above or disclosed elsewhere herein, d ranges from greater than 10 to less than 17.5, and the CIELAB L* value of the metallic glass is greater than 78.

In other embodiments related to those above or disclosed elsewhere herein, d ranges from 8 to less than 17.5.

In other embodiments related to those above or disclosed elsewhere herein, d ranges from 8 to less than 17.5, and the CIELAB L* value of the metallic glass is greater than 78.

In other embodiments related to those above or disclosed elsewhere herein, d ranges from 9 to less than 17.5.

In other embodiments related to those above or disclosed elsewhere herein, d ranges from 9 to less than 17.5, and the CIELAB L* value of the metallic glass is greater than 78.

In other embodiments related to those above or disclosed elsewhere herein, d ranges from 10 to less than 17.5.

In other embodiments related to those above or disclosed elsewhere herein, d ranges from 10 to less than 17.5, and the CIELAB L* value of the metallic glass is greater than 78.

In other embodiments related to those above or disclosed elsewhere herein, d ranges from 8 to 16.

In other embodiments related to those above or disclosed elsewhere herein, d ranges from 8 to 16, and the CIELAB L* value of the metallic glass is greater than 78.2.

In other embodiments related to those above or disclosed elsewhere herein, d ranges from 8 to 16, and the notch toughness of the metallic glass is at least 70 MPa $m^{1/2}$.

In other embodiments related to those above or disclosed elsewhere herein, d ranges from 9 to 16.

In other embodiments related to those above or disclosed elsewhere herein, d ranges from 9 to 16, and the CIELAB L* value of the metallic glass is greater than 78.2.

In other embodiments related to those above or disclosed elsewhere herein, d ranges from 9 to 16, and the notch toughness of the metallic glass is at least 70 MPa $m^{1/2}$.

In other embodiments related to those above or disclosed elsewhere herein, d ranges from 10 to 16.

In other embodiments related to those above or disclosed elsewhere herein, d ranges from 10 to 16, and the CIELAB L* value of the metallic glass is greater than 78.2.

In other embodiments related to those above or disclosed elsewhere herein, d ranges from 10 to 16, and the notch toughness of the metallic glass is at least 70 MPa $m^{1/2}$.

In other embodiments related to those above or disclosed elsewhere herein, d ranges from 8 to less than 15.

In other embodiments related to those above or disclosed elsewhere herein, d ranges from 8 to less than 15, and the CIELAB L* value of the metallic glass is greater than 78.4.

In other embodiments related to those above or disclosed elsewhere herein, d ranges from 9 to less than 15.

In other embodiments related to those above or disclosed elsewhere herein, d ranges from 9 to less than 15, and the CIELAB L* value of the metallic glass is greater than 78.4.

In other embodiments related to those above or disclosed elsewhere herein, d ranges from 10 to less than 15.

In other embodiments related to those above or disclosed elsewhere herein, d ranges from 10 to less than 15, and the CIELAB L* value of the metallic glass is greater than 78.4.

In other embodiments related to those above or disclosed elsewhere herein, d ranges from 8 to 15.5.

In other embodiments related to those above or disclosed elsewhere herein, d ranges from 8 to 15.5, and the notch toughness of the metallic glass is at least 80 MPa $m^{1/2}$.

In other embodiments related to those above or disclosed elsewhere herein, d ranges from 9 to 15.5.

In other embodiments related to those above or disclosed elsewhere herein, d ranges from 8 to 15.5, and the notch toughness of the metallic glass is at least 80 MPa $m^{1/2}$.

In other embodiments related to those above or disclosed elsewhere herein, d ranges from 10 to 15.5.

In other embodiments related to those above or disclosed elsewhere herein, d ranges from 10 to 15.5, and the notch toughness of the metallic glass is at least 80 MPa $m^{1/2}$.

In other embodiments related to those above or disclosed elsewhere herein, d ranges from greater than 10 to 15.5.

In other embodiments related to those above or disclosed elsewhere herein, d ranges from 10 to 15.5, and the notch toughness of the metallic glass is at least 90 MPa $m^{1/2}$.

In other embodiments related to those above or disclosed elsewhere herein, the metallic glass-forming alloy or metallic glass may also comprise Nb, Ag, Pd, Pt, Fe, Sn, Si, Ge, B and Be in a combined atomic concentration of up to 2%.

In other embodiments related to those above or disclosed elsewhere herein, the metallic glass-forming alloy or metallic glass may also comprise Nb as a substitute for either Zr or Ti in an atomic concentration of up to 2%.

In other embodiments related to those above or disclosed elsewhere herein, the metallic glass-forming alloy or metallic glass may also comprise at least one of Ag, Pd, Pt, and Fe as a substitute for either Co or Ni in a combined atomic concentration of up to 2%.

In other embodiments related to those above or disclosed elsewhere herein, the metallic glass-forming alloy or metallic glass may also comprise at least one of Sn, Si, Ge, B and Be as a substitute for Al in a combined atomic concentration of up to 2%.

Many embodiments related to those above or elsewhere disclosed herein are also directed to methods of forming a metallic glass, or an article made of a metallic glass, from the metallic glass-forming alloy.

In other embodiments related to those above or disclosed elsewhere herein methods may include heating and melting an ingot comprising the metallic glass-forming alloy under inert atmosphere to create a molten alloy, and subsequently quenching the molten alloy fast enough to avoid crystallization of the molten alloy.

In other embodiments related to those above or disclosed elsewhere herein, prior to quenching the molten alloy is heated to at least 100° C. above the liquidus temperature of the metallic glass-forming alloy.

In other embodiments related to those above or disclosed elsewhere herein, prior to quenching the molten alloy is heated to at least 200° C. above the liquidus temperature of the metallic glass-forming alloy.

In yet other embodiments related to those above or disclosed elsewhere herein, prior to quenching the molten alloy is heated to at least 1100° C.

In yet other embodiments related to those above or disclosed elsewhere herein, prior to quenching the molten alloy is heated to at least 1200° C.

Many embodiments related to those above or elsewhere disclosed herein are also directed to methods of thermoplastically shaping a metallic glass into an article, including:

heating a sample of the metallic glass to a softening temperature $T_o$ above the glass transition temperature $T_g$, of the metallic glass to create a heated sample;

applying a deformational force to shape the heated sample over a time $t_o$ that is shorter than the time it takes for the metallic glass to crystallize at $T_o$, and cooling the heated sample to a temperature below $T_g$ to form an article.

In other embodiments related to those above or disclosed elsewhere herein, $T_o$ is higher than $T_g$ and lower the liquidus temperature of the metallic glass-forming alloy.

In other embodiments related to those above or disclosed elsewhere herein, $T_o$ is greater than $T_g$ and lower than $T_x$.

In other embodiments related to those above or disclosed elsewhere herein, $T_o$ is higher than $T_x$ and lower than the solidus temperature of the metallic glass-forming alloy.

In other embodiments related to those above or disclosed elsewhere herein, $T_o$ is in the range of 450 to 800° C.

In other embodiments related to those above or disclosed elsewhere herein, $T_o$ is in the range of 500 to 750° C.

In other embodiments related to those above or disclosed elsewhere herein, $T_o$ is in the range of 525 to 700° C.

In other embodiments related to those above or disclosed elsewhere herein, $T_o$ is in the range of 550 to 650° C.

In other embodiments related to those above or disclosed elsewhere herein, the viscosity of the sample at $T_o$ is less than $10^5$ Pa—s.

In other embodiments related to those above or disclosed elsewhere herein, the viscosity of the sample at $T_o$ is in the range of $10^0$ to $10^5$ Pa—s.

In other embodiments related to those above or disclosed elsewhere herein, the viscosity of the sample at $T_o$ is in the range of $10^1$ to $10^4$ Pa—s.

In other embodiments related to those above or disclosed elsewhere herein, heating of the sample of the metallic glass-forming alloy is performed by conduction to a hot surface.

In other embodiments related to those above or disclosed elsewhere herein, heating of the sample of the metallic glass-forming alloy is performed by inductive heating.

In other embodiments related to those above or disclosed elsewhere herein, heating of the sample of the metallic glass-forming alloy is performed by ohmic heating.

In other embodiments related to those above or disclosed elsewhere herein, the ohmic heating is performed by the discharge of at least one capacitor.

Many embodiments, including those disclosed above or elsewhere are also directed to a metallic glass-forming alloy or a metallic glass having compositions selected from a group consisting of: $Zr_{60}Co_{17.5}Ni_{12.5}Al_{10}$, $Zr_{57.5}Co_{17.5}Ni_{12.5}Al_{12.5}$, $Zr_{55}Co_{17.5}Ni_{12.5}Al_{15}$, $Zr_{52.5}Co_{17.5}Ni_{12.5}Al_{17.5}$, $Zr_{62.5}Co_{12.5}Ni_{12.5}Al_{12.5}$, $Zr_{60}Co_{15}Ni_{12.5}Al_{12.5}$, $Zr_{55}Co_{20}Ni_{12.5}Al_{12.5}$, $Zr_{57.5}Co_{20}Ni_{10}Al_{12.5}$, $Zr_{57.5}Co_{15}Ni_{15}Al_{12.5}$, $Zr_{57.5}Co_{12.5}Ni_{17.5}Al_{12.5}$, $Zr_{56.5}Ti_1Co_{17.5}Ni_{12.5}Al_{12.5}$, $Zr_{55.5}Ti_2Co_{17.5}Ni_{12.5}Al_{12.5}$, $Zr_{54.5}Ti_3Co_{17.5}Ni_{12.5}Al_{12.5}$, $Zr_{53.5}Ti_4CO_{17.5}Ni_{12.5}Al_{12.5}$, $Zr_{53}Ti_{4.5}Co_{17.5}Ni_{12.5}Al_{12.5}$, $Zr_{52.5}Ti_5Co_{17.5}Ni_{12.5}Al_{12.5}$, $Zr_{51.5}Ti_6Co_{17.5}Ni_{12.5}Al_{2.5}$, and $Zr_{50.5}Ti_7Co_{17.5}Ni_{12.5}Al_{12.5}$.

Additional embodiments and features are set forth in part in the description that follows, and in part will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure.

DETAILED DESCRIPTION

The disclosure may be understood by reference to the following detailed description, taken in conjunction with the drawings as described below. It is noted that, for purposes of illustrative clarity, certain elements in various drawings may not be drawn to scale. The embodiments of the inventive methods and apparatus described herein are not intended to be exhaustive or to limit the inventive methods and apparatus to precise forms disclosed. Rather, the embodiments selected for description have been chosen to enable one skilled in the art to practice the invention.

In the disclosure, the glass-forming ability of each alloy is quantified by the "critical plate thickness," defined as the largest plate thickness in which the amorphous phase can be formed when processed by a method of casting the molten alloy in a copper mold having a prismatic cavity (i.e. a cavity having a rectangular cross section), where at least one dimension of the prismatic cavity is less than 50% of at least one other dimension of the prismatic cavity.

A "critical cooling rate," which is defined as the cooling rate required to avoid crystallization and form the amorphous phase of the metallic glass-forming alloy (i.e. the metallic glass), determines the critical plate thickness. The lower the critical cooling rate of a metallic glass-forming alloy, the larger its critical plate thickness. The critical cooling rate $R_c$ in K/s and critical plate thickness $t_c$ in mm are related via the following approximate empirical formula:

$$R_c=1000/t_c^2 \quad \text{EQ. (1)}$$

According to EQ. (1), the critical cooling rate for a metallic glass-forming alloy having a critical casting thickness of about 1 mm is about $10^3$ K/s.

Generally, three categories are known in the art for identifying the ability of a metal alloy to form a metallic glass (i.e. to bypass the stable crystal phase and form an amorphous phase). Alloys having critical cooling rates in excess of $10^{12}$ K/s are typically referred to as non-glass formers, as it is physically impossible to achieve such cooling rates over a meaningful thickness. Alloys having critical cooling rates in the range of $10^5$ to $10^{12}$ K/s are typically referred to as marginal glass formers, as they are able to form metallic glass foils or ribbons with thicknesses ranging from 1 to 100 micrometers according to EQ. (1). Metal alloys having critical cooling rates on the order of $10^3$ or less, and as low as 1 or 0.1 K/s, are typically referred to as bulk glass formers, as they are able to form metallic glass plates with thicknesses ranging from 1 millimeter to several centimeters. The glass-forming ability of a metallic alloy is, to a very large extent, dependent on the composition of the metallic glass-forming alloy. The compositional ranges for alloys that are marginal glass formers are considerably broader than those for bulk glass formers. Among all metals, Zr is the base metal having the most discovered alloy combinations of forming a metallic glass. Various Zr-based metallic glass-forming alloys have been discovered, some marginal glass formers (capable of forming only micron thick ribbons) while others bulk glass formers (capable of forming only centimeter thick plates).

Often in the art, a measure of glass forming ability of an alloy is reported as the critical rod diameter instead of the critical plate thickness. Due to its symmetry, the diameter of a rod for which a certain cooling rate is achieved at its centerline is about twice the thickness of a plate for which the same cooling rate is achieved at its centerline. Hence, the critical rod diameter to achieve a critical cooling rate is about twice the critical plate thickness to achieve the same critical cooling rate. Therefore, a critical rod diameter can be approximately converted to a critical plate thickness by dividing by 2.

To characterize, specify, and quantify the color of metal alloys, the modern CIELAB coordinate system is used, originating from the 1948 3D color space of Hunter (Hunter, Richard Sewall (July 1948). "Photoelectric Color-Difference Meter." JOSA 38 (7): 661. (Proceedings of the Winter Meeting of the Optical Society of America), the disclosure of which is incorporated herein by reference in its entirety). In Hunter's color space, the color of a metal alloy is characterized by three optically measurable coordinates a*, b*, and L* that respectively map color onto a red-green, blue-yellow, and color intensity (i.e. luminance) scales. The color of any particular metal alloy is determined using a common optical spectrometer to measure its a*, b*, and L* coordinates in color space. The ability to produce alloys with specified ranges of color coordinates is key to the design and use of gold alloys in commercial products.

Owing to their high hardness, which is far superior to conventional (i.e. crystalline) metals, metallic glasses were thought of as attractive materials for cosmetic metal applications (e.g. for watches or other luxury goods). Recently, considerable interest has been demonstrated in the design of metallic glasses having cosmetic appearance and color within specified color coordinates. One cosmetic color attribute currently of interest is the lightness—also referred to as reflectivity—quantified by the CIELAB coordinate L*. The reflectivity of metallic glasses, particularly Zr-based metallic glasses, is generally low compared to conventional metal alloys that are currently used as cosmetic products (e.g. stainless steel). In Table 1, data for the CIELAB color coordinates L*, a*, and b* of various known Zr-based metallic glasses is presented together with data for AISI 316 stainless steel. In FIG. 1 the reflectivity of the various Zr-based metallic glasses is compared against the reflectivity of AISI 316 stainless steel. As seen in Table 1 and FIG. 1, Zr-based metallic gasses $Zr_{52.5}Ti_5Cu_{17.9}Ni_{14.6}Al_{10}$, $Zr_{58}Cu_{22}Fe_8Al_{12}$, $Zr_{56}Ni_{25}Nb_4Al_{15}$, and $Zr_{57}Nb_5Cu_{15.4}Ni_{12.6}Al_{12.5}$ have L* values below 78, while AISI 316 stainless steel has an L* value of 84.6. This deficiency renders Zr-based metallic glasses inferior to conventional alloys such as stainless steel in cosmetic metal applications.

TABLE 1

CIELAB color coordinates of various Zr-based metallic glasses and AISI 316 stainless steel

| Composition (at. %) | L* | a* | b* |
|---|---|---|---|
| $Zr_{52.5}Ti_5Cu_{17.9}Ni_{14.6}Al_{10}$ | 77.38 | 0.64 | 3.89 |
| $Zr_{58}Cu_{22}Fe_8Al_{12}$ | 77.62 | 0.66 | 5.48 |
| $Zr_{56}Ni_{25}Nb_4Al_{15}$ | 77.85 | 0.64 | 3.01 |
| $Zr_{57}Nb_5Cu_{15.4}Ni_{12.6}Al_{10}$ | 77.99 | 0.67 | 3.71 |
| AISI 316 Stainless Steel | 84.6 | 0.11 | 2.6 |

To overcome this limitation, Zr-based metallic glasses having reflectivity L* approaching that of the incumbent crystalline metal alloys while being able to form in bulk dimensions are desired. As such, Zr-based metallic glass-forming alloys having a high glass-forming ability and where the metallic glasses formed from the alloys demonstrate a high reflectivity would be attractive materials for cosmetic metal applications. As discussed above, discovering compositional regions where a metal alloy demonstrates a high glass forming ability is unpredictable. Discovering compositional regions where a metallic glass demonstrates a high reflectivity L* is equally unpredictable. Discovering compositional regions where both a high glass forming ability and a high reflectivity L* coexist is even more unpredictable than the two cases above, because the compositional region where a metallic glass-forming alloy would demonstrate a high glass forming ability would not necessarily coincide with the compositional regions where a metallic glass would demonstrate a high reflectivity L*. In some embodiments of the disclosure, a critical plate thickness of at least 2 mm and a reflectivity L* of at least 78 are considered adequate for qualifying the metallic glass as suitable for cosmetic metal applications.

In this disclosure, compositional regions in the Zr—Co—Ni—Al and Zr—Ti—Co—Ni—Al alloys are disclosed where the metallic glass-forming alloys demonstrate a high glass forming ability while the metallic glasses formed from the alloys exhibit a high reflectivity. In embodiments of the disclosure, the metallic glass-forming alloys demonstrate a critical plate thickness of at least 2 mm, while the metallic glasses formed from the alloys demonstrate a CIELAB L* value of at least 78. In some embodiments, the critical plate thickness is at least 3 mm, in other embodiments the critical plate thickness is at least 4 mm, while in yet other embodiments the critical plate thickness is at least 5 mm. In some embodiments, the CIELAB L* value is at least 78.2, while in other embodiments at least 78.4.

Figure 2:
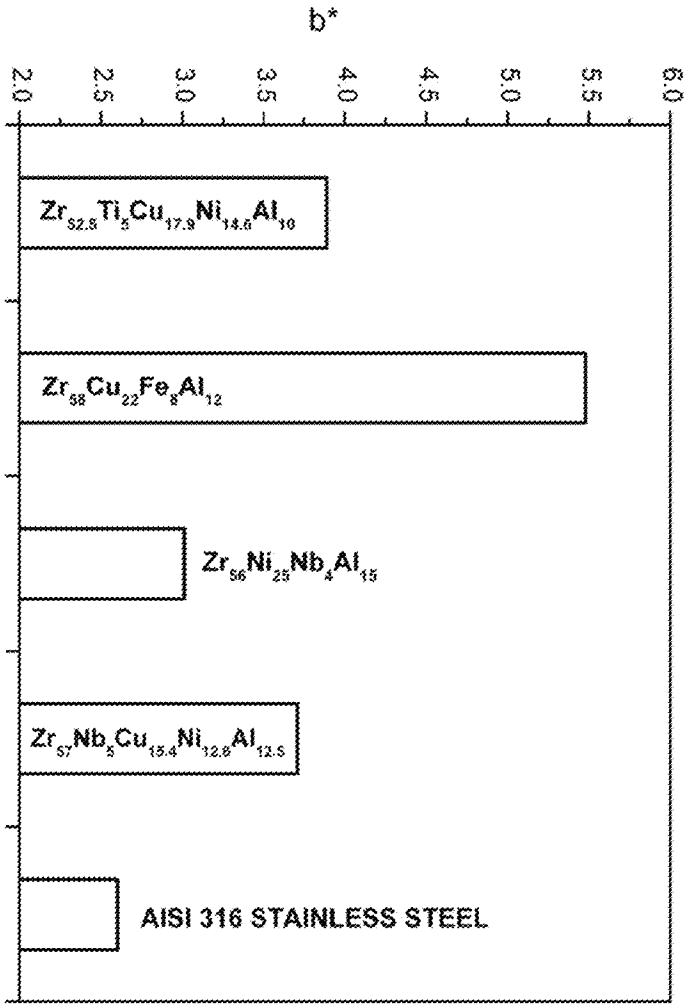
FIG. 2 presents a bar plot comparing the CIELAB b* values of various known Zr-based metallic glasses against that of AISI 316 stainless steel.

Another cosmetic color attribute that metallic glasses generally fall short of is the CIELAB b* coordinate, which represents the yellow/blue opponent colors. Many Zr-based metallic glasses have relatively high b* values, which is considerably higher than conventional metal alloys that are currently used as cosmetic products (e.g. stainless steel). In Table 1 and FIG. 2 the b* values of various known Zr-based metallic glasses are compared against that of AISI 316 stainless steel. As seen in Table 1 and FIG. 2, Cu-bearing Zr-based metallic gasses $Zr_{52.5}Ti_5Cu_{17.9}Ni_{14.6}Al_{10}$, $Zr_{58}Cu_{22}Fe_8Al_{12}$, and $Zr_{57}Nb_5Cu_{15.4}Ni_{12.6}Al_{12.5}$ have b* values ranging from about 3.7 to about 5.5, while Cu-free Zr-based metallic glass $Zr_{56}Ni_{25}Nb_4Al_{15}$ has a b* value of about 3. On the other hand, AISI 316 stainless steel has a b* value of 2.6. This deficiency renders Zr-based metallic glasses, especially those bearing Cu, inferior to conventional alloys such as stainless steel in cosmetic metal applications. In some embodiments of the disclosure, a CIELAB b* value of equal to or less than 3.5 is considered adequate for qualifying the metallic glass for cosmetic metal applications. In other embodiments, a CIELAB b* value of equal to or less than 3.25 may be adequate for such applications, while in yet other embodiments a CIELAB b* value of equal to or less than 3 may be adequate for such applications.

Another property of the metallic glass that may be regarded as critical for engineering metal applications, including cosmetic metal applications, is the toughness of the metallic glass. The notch toughness, defined as the stress intensity factor at crack initiation $K_q$, is the measure of the material's ability to resist fracture in the presence of a notch. A high $K_q$ ensures that the material will be tough in the presence of defects. In embodiments of the disclosure, a notch toughness of at least 70 MPa $m^{1/2}$ is considered adequate for qualifying the metallic glass for cosmetic metal applications. In other embodiments, a notch toughness of at least 80 MPa $m^{1/2}$ may be adequate for such application, while in yet other embodiments a notch toughness of at least 90 MPa $m^{1/2}$ may be adequate for such application.

The disclosure is also directed to methods of forming a metallic glass, or an article made of a metallic glass, from the metallic glass-forming alloy. In various embodiments, a metallic glass is formed by heating and melting an alloy ingot under inert atmosphere to create a molten alloy, and subsequently quenching the molten alloy fast enough to avoid crystallization of the molten alloy. In one embodiment, prior to cooling the molten alloy is heated to at least 100° C. above the liquidus temperature of the metallic glass-forming alloy. In another embodiment, prior to quenching the molten alloy is heated to at least 200° C. above the liquidus temperature of the metallic glass-forming alloy. In another embodiment, prior to quenching the molten alloy is heated to at least 1100° C. In yet another embodiment, prior to quenching the molten alloy is heated to at least 1200° C. In one embodiment, the alloy ingot is heated and melted using a plasma arc. In another embodiment, the alloy ingot is heated and melted using an induction coil. In some embodiments, the alloy ingot is heated and melted over a water-cooled hearth, or within a water-cooled crucible. In one embodiment, the hearth or crucible is made of copper. In some embodiments, the inert atmosphere comprises argon gas. In some embodiments, quenching of the molten alloy is performed by injecting or pouring the molten alloy into a metal mold. In some embodiments, the mold can be made of copper, brass, or steel, among other materials. In some embodiments, injection of the molten alloy is performed by a pneumatic drive, a hydraulic drive, an electric drive, or a magnetic drive. In some embodiments, pouring the molten alloy into a metal mold is performed by tilting a tundish containing the molten alloy.

The disclosure is also directed to methods of thermoplastically shaping a metallic glass into an article. In some embodiments, heating of the metallic glass is performed by conduction to a hot surface. In other embodiments, heating of the metallic glass to a softening temperature $T_o$ above the glass transition temperature $T_g$ is performed by inductive heating. In yet other embodiments, heating of the metallic glass to a softening temperature $T_o$ above the glass transition temperature $T_g$ is performed by ohmic heating. In one embodiment, the ohmic heating is performed by the discharge of at least one capacitor. In some embodiments, the application of the deformational force to thermoplastically shape the softened metallic glass in the supercooled liquid region is performed by a pneumatic drive, a hydraulic drive, an electric drive, or a magnetic drive.

Description of the Metallic Glass Forming Region

In various embodiments, the disclosure provides Zr—Co—Ni—Al alloys optionally bearing Ti capable of forming metallic glasses. The alloys demonstrate a high glass forming ability while the metallic glass formed from the alloys exhibit with a high reflectivity.

Specifically, the disclosure provides a narrow compositional range of Zr—Ti—Co—Ni—Al metallic glass-forming alloys and metallic glasses over which the alloys demonstrate a critical plate thickness of at least 2 mm, while the metallic glasses formed from the alloys exhibit a CIELAB L* value of at least 78.

In one embodiment, the disclosure provides an alloy capable of forming a metallic glass having a composition represented by the following formula (subscripts denote atomic percentages):

$$Zr_{(100-a-b-c-d)}Ti_aCo_bNi_cAl_d \quad \text{EQ. (2)}$$

where:

a is up to 10;

b ranges from 12 to 22;

c ranges from 8 to 20; and d ranges from 8 to 18, wherein the critical plate thickness of the alloy is at least 2 mm, and wherein the CIELAB L* value of the metallic glass is at least 78.

Specific embodiments of metallic glasses formed of metallic glass-forming alloys with compositions according to the formula $Zr_{70-x}Co_{17.5}Ni_{12.5}Al_x$ are presented in Table 2. In these alloys, Al is varied at the expense Zr, where the atomic fraction of Al increases from 7.5 to 20 percent as the atomic fraction of Zr decreases from 62.5 to 50 percent, while the atomic fractions of Co and Ni are fixed at 17.5 and 12.5 percent, respectively.

TABLE 2

Sample metallic glasses demonstrating the effect of increasing the Al atomic concentration at the expense of Zr according to the formula $Zr_{70-x}Co_{17.5}Ni_{12.5}Al_x$ on the glass forming ability, glass-transition temperature, and crystallization temperature

| Example | Composition | Critical Plate Thickness [mm] | $T_g$ (° C.) | $T_x$ (° C.) |
|---|---|---|---|---|
| 1 | $Zr_{62.5}Co_{17.5}Ni_{12.5}Al_{7.5}$ | <2 | N/A | N/A |
| 2 | $Zr_{60}Co_{17.5}Ni_{12.5}Al_{10}$ | 2 | 416.5 | 459.5 |
| 3 | $Zr_{57.5}Co_{17.5}Ni_{12.5}Al_{12.5}$ | 3 | 426.6 | 479.2 |
| 4 | $Zr_{55}Co_{17.5}Ni_{12.5}Al_{15}$ | 3 | 442.1 | 506.2 |
| 5 | $Zr_{52.5}Co_{17.5}Ni_{12.5}Al_{17.5}$ | 2 | 458.7 | 529.6 |
| 6 | $Zr_{50}Co_{17.5}Ni_{12.5}Al_{20}$ | <2 | N/A | N/A |

Figure 3:
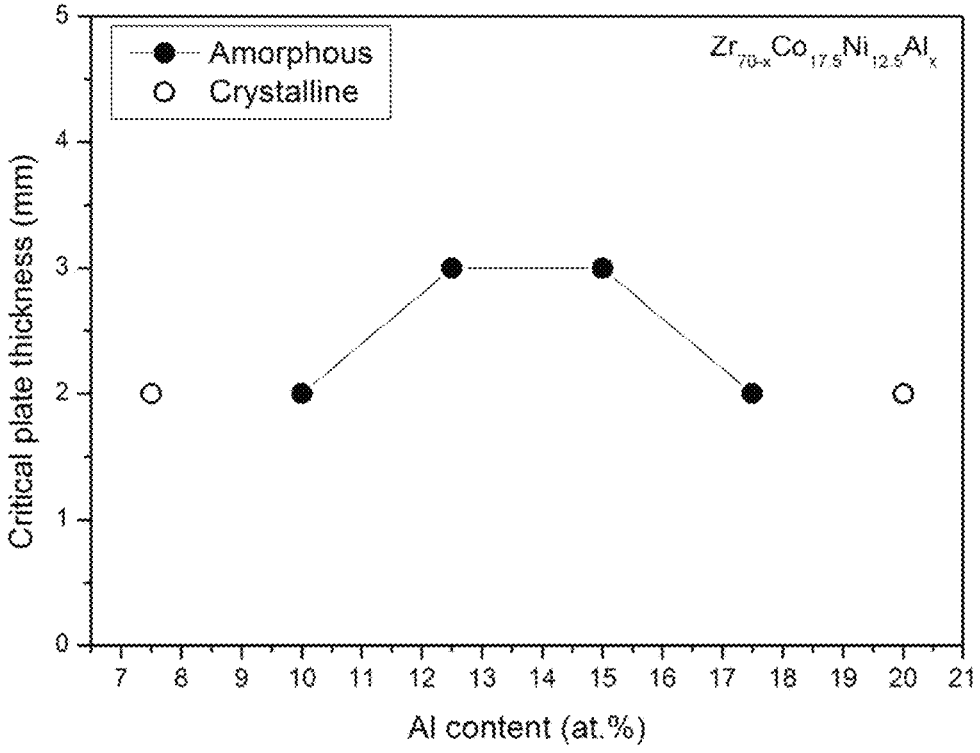
FIG. 3 provides a plot of the critical plate thickness of metallic glass-forming alloys according to composition formula $Zr_{70-x}Co_{17.5}Ni_{12.5}Al_x$ in accordance with embodiments of the disclosure.

The critical plate thicknesses values of the example alloys according to the composition formula $Zr_{70-x}Co_{17.5}Ni_{12.5}Al_x$ are listed in Table 2, and are plotted in FIG. 3. As shown in Table 2 and FIG. 3, substituting Zr by Al according to $Zr_{70-x}Co_{17.5}Ni_{12.5}Al_x$ results in varying glass forming ability. Specifically, the critical plate thickness increases from less than 2 mm for the metallic glass-forming alloy containing 7.5 atomic percent Al (Example 1) to 2 mm for the metallic glass-forming alloy containing 7.5 atomic percent Al (Example 2), reaches the highest value of 3 mm for the metallic glass-forming alloys containing 12.5 and 15 atomic percent Al (Examples 3 and 4), and decreases back to 2 mm for the metallic glass-forming alloy containing 17.5 atomic percent Al (Example 5) and to less than 2 mm for the metallic glass-forming alloy containing 20 atomic percent Al (Example 6). Therefore, in the range where the Al content varies between 10 and 17.5 atomic percent, the critical plate thickness of $Zr_{70-x}Co_{17.5}Ni_{12.5}Al_x$ metallic glasses is at least 2 mm.

Figure 4:
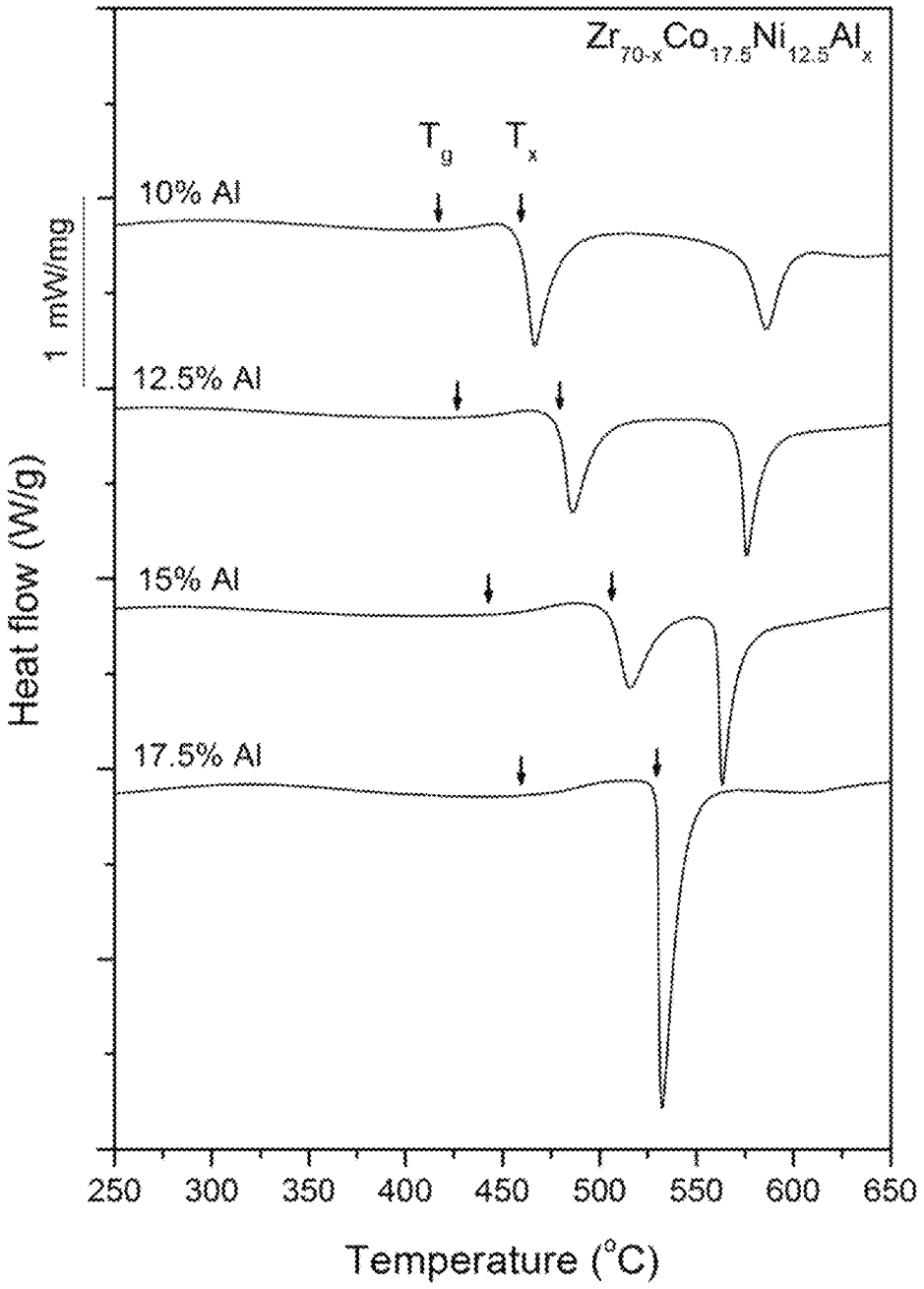
FIG. 4 provides calorimetry scans for sample metallic glasses according to $Zr_{70-x}Co_{17.5}Ni_{12.5}Al_x$ in accordance with embodiments of the disclosure, where the glass transition temperature $T_g$ and crystallization temperature $T_x$ are indicated by arrows.

FIG. 4 provides calorimetry scans for sample metallic glasses according to the formula $Zr_{70-x}Co_{17.5}Ni_{12.5}Al_x$ in accordance with embodiments of the disclosure. The glass transition temperature $T_g$ and crystallization temperature $T_x$ of the metallic glasses are indicated by arrows in FIG. 4, and are listed in Table 2.

Figure 5:
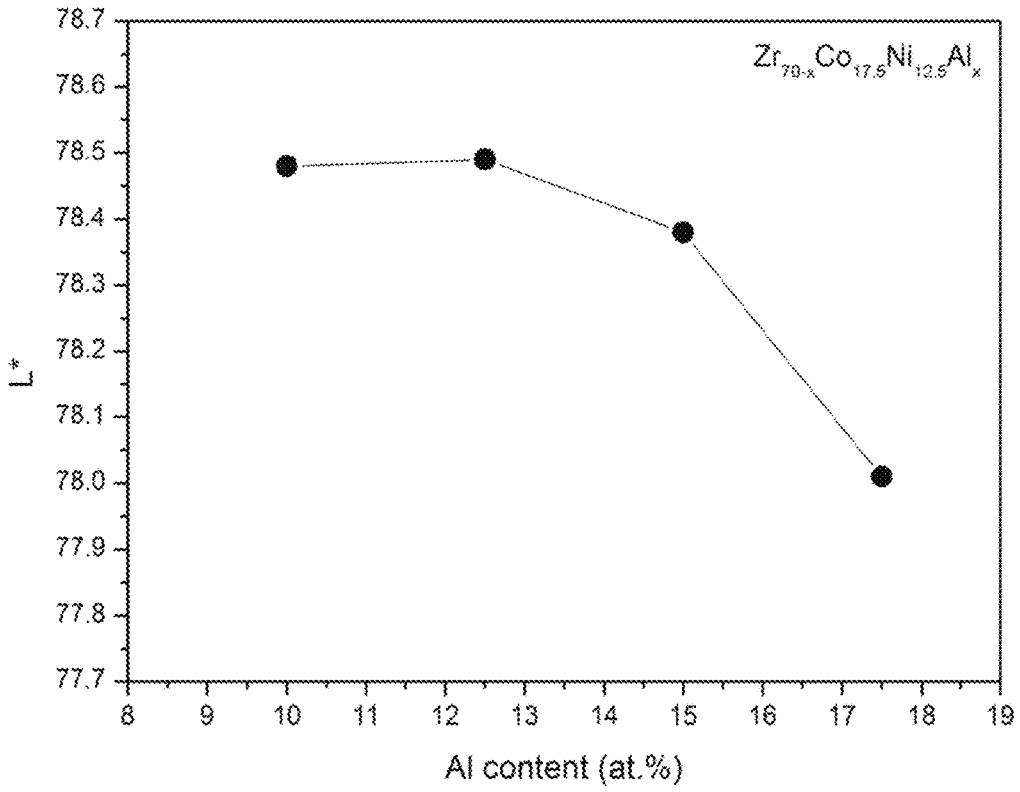
FIG. 5 provides a plot of the CIELAB L* (reflectivity) value of metallic glasses according to composition formula $Zr_{70-x}Co_{17.5}Ni_{12.5}Al_x$ in accordance with embodiments of the disclosure.

The measured CIELAB color coordinates L*, a*, and b* of the example metallic glasses according to the composition formula $Zr_{70-x}Co_{17.5}Ni_{12.5}Al_x$ are listed in Table 3. The CIELAB L* (reflectivity) values listed in Table 3 are plotted in FIG. 5. As shown in Table 3 and FIG. 5, substituting Zr by Al according to $Zr_{70-x}Co_{17.5}Ni_{12.5}Al_x$ results in varying L*. Specifically, L* decreases with increasing Al content, from a high value of 78.48 for the metallic glass containing 10 atomic percent Al (Example 2) to 78.01 for the metallic glass containing 17.5 atomic percent Al (Example 5). Therefore, in the range where the Al content is equal to or less than 17.5 atomic percent, the reflectivity of $Zr_{70-x}Co_{17.5}Ni_{12.5}Al_x$ metallic glasses is at least 78.

TABLE 3

Sample metallic glasses demonstrating the effect of increasing the Al atomic concentration at the expense of Zr according to the formula $Zr_{70-x}Co_{17.5}Ni_{12.5}Al_x$ on the CIELAB color coordinates of the metallic glasses

| Example | Composition (at. %) | L* | a* | b* |
|---|---|---|---|---|
| 2 | $Zr_{60}Co_{17.5}Ni_{12.5}Al_{10}$ | 78.48 | 0.62 | 3.17 |
| 3 | $Zr_{57.5}Co_{17.5}Ni_{12.5}Al_{12.5}$ | 78.49 | 0.61 | 3.04 |
| 4 | $Zr_{55}Co_{17.5}Ni_{12.5}Al_{15}$ | 78.38 | 0.60 | 2.98 |
| 5 | $Zr_{52.5}Co_{17.5}Ni_{12.5}Al_{17.5}$ | 78.01 | 0.59 | 2.96 |

Figure 6:
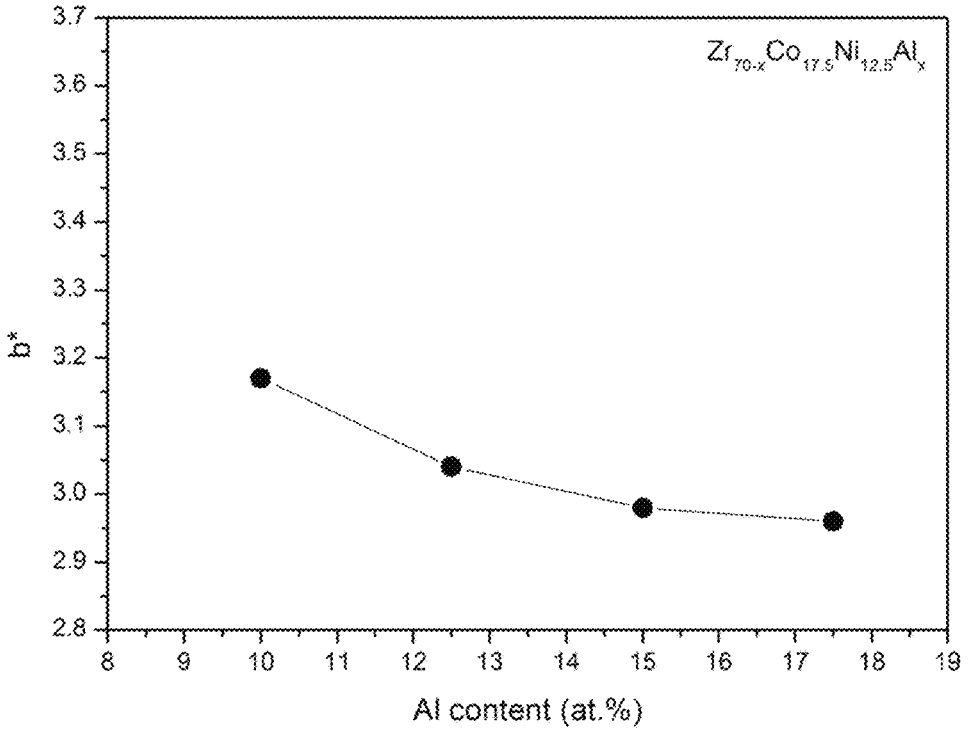
FIG. 6 provides a plot of the CIELAB b* value of metallic glasses according to composition formula $Zr_{70-x}Co_{17.5}Ni_{12.5}Al_x$ in accordance with embodiments of the disclosure.

The CIELAB b* values of the example metallic glasses listed in Table 3 are plotted in FIG. 6. As shown in Table 3 and FIG. 6, b* decreases slightly with increasing Al content, from 3.17 for the metallic glass containing 10 atomic percent Al (Example 2) to 2.96 for the metallic glass containing 17.5 atomic percent Al (Example 5). Therefore, in the range where the Al content varies between 10 and 17.5 atomic percent, the b* value of $Zr_{70-x}Co_{17.5}Ni_{12.5}Al_x$ metallic glasses is less than 3.2. Lastly, the CIELAB a* value decreases slightly with increasing Al content, from a high value of 0.62 for the metallic glass containing 10 atomic percent Al (Example 2) to 0.59 for the metallic glass containing 17.5 atomic percent Al (Example 5).

Figure 7:
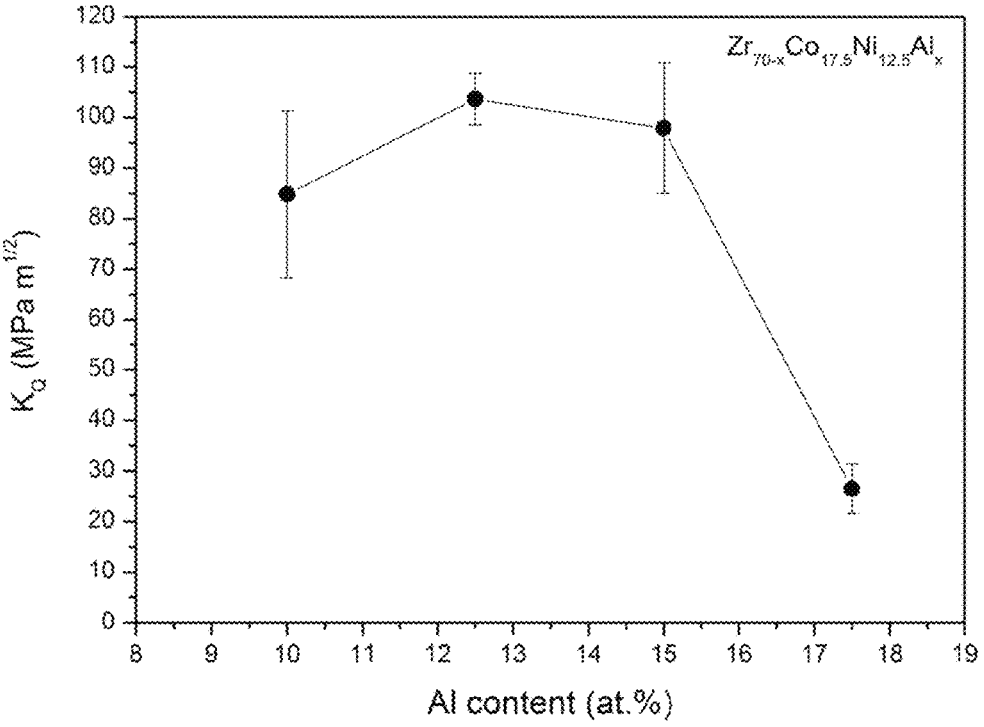
FIG. 7 provides a plot of the notch toughness $K_Q$ of metallic glasses according to composition formula $Zr_{70-x}Co_{17.5}Ni_{12.5}Al_x$ in accordance with embodiments of the disclosure.

The measured notch toughness $K_Q$ of the example metallic glasses according to the composition formula $Zr_{70-x}Co_{17.5}Ni_{12.5}Al_x$ are listed in Table 4. The $K_Q$ values listed in Table 4 are plotted in FIG. 7. As shown in Table 4 and FIG. 7, substituting Zr by Al according to $Zr_{70-x}Co_{17.5}Ni_{12.5}Al_x$ results in varying $K_Q$. Specifically, in the range where the Al content varies between 10 and 15 atomic percent, $K_Q$ has a high value ranging between 84.8 and 103.6 MPa $m^{1/2}$. However, $K_Q$ drops considerably at higher Al content, dripping to a value of 26.5 MPa $m^{1/2}$ when the Al content is 17.5 atomic percent. Therefore, in the range where the Al content is less than 17.5 atomic percent, the notch toughness of $Zr_{70-x}Co_{17.5}Ni_{12.5}Al_x$ metallic glasses is at least 80 MPa $m^{1/2}$.

TABLE 4

Sample metallic glasses demonstrating the effect of increasing the Al atomic concentration at the expense of Zr according to the formula $Zr_{70-x}Co_{17.5}Ni_{12.5}Al_x$ on the notch toughness of the metallic glasses

| Example | Composition | Notch Toughness $K_Q$ (MPa $m^{1/2}$) |
|---|---|---|
| 2 | $Zr_{60}Co_{17.5}Ni_{12.5}Al_{10}$ | 84.8 ± 16.5 |
| 3 | $Zr_{57.5}Co_{17.5}Ni_{12.5}Al_{12.5}$ | 103.6 ± 5.1 |
| 4 | $Zr_{55}Co_{17.5}Ni_{12.5}Al_{15}$ | 97.9 ± 12.9 |
| 5 | $Zr_{52.5}Co_{17.5}Ni_{12.5}Al_{17.5}$ | 26.5 ± 4.9 |

Specific embodiments of metallic glasses formed of metallic glass-forming alloys with compositions according to the formula $Zr_{75-x}Co_xNi_{12.5}Al_{12.5}$ are presented in Table 5. In these alloys, Co is varied at the expense Zr, where the atomic fraction of Co increases from 10 to 22.5 percent as the atomic fraction of Zr decreases from 65 to 52.5 percent, while the atomic fractions of Ni and Al are both fixed at 12.5 percent.

TABLE 5

Sample metallic glasses demonstrating the effect of increasing the Co atomic concentration at the expense of Zr according to the formula $Zr_{75-x}Co_xNi_{12.5}Al_{12.5}$ on the glass forming ability, glass-transition temperature and crystallization temperature

| Example | Composition | Critical Plate Thickness [mm] | $T_g$ (° C.) | $T_x$ (° C.) |
|---|---|---|---|---|
| 7 | $Zr_{65}Co_{10}Ni_{12.5}Al_{12.5}$ | <2 | 387.2 | 444.9 |
| 8 | $Zr_{62.5}Co_{12.5}Ni_{12.5}Al_{12.5}$ | 2 | 404.5 | 451.5 |
| 9 | $Zr_{60}Co_{15}Ni_{12.5}Al_{12.5}$ | 3 | 412.9 | 464.3 |
| 3 | $Zr_{57.5}Co_{17.5}Ni_{12.5}Al_{12.5}$ | 3 | 426.6 | 479.2 |
| 10 | $Zr_{55}Co_{20}Ni_{12.5}Al_{12.5}$ | 2 | 441.3 | 494.4 |
| 11 | $Zr_{52.5}Co_{22.5}Ni_{12.5}Al_{12.5}$ | <2 | 452.4 | 517.0 |

Figure 8:
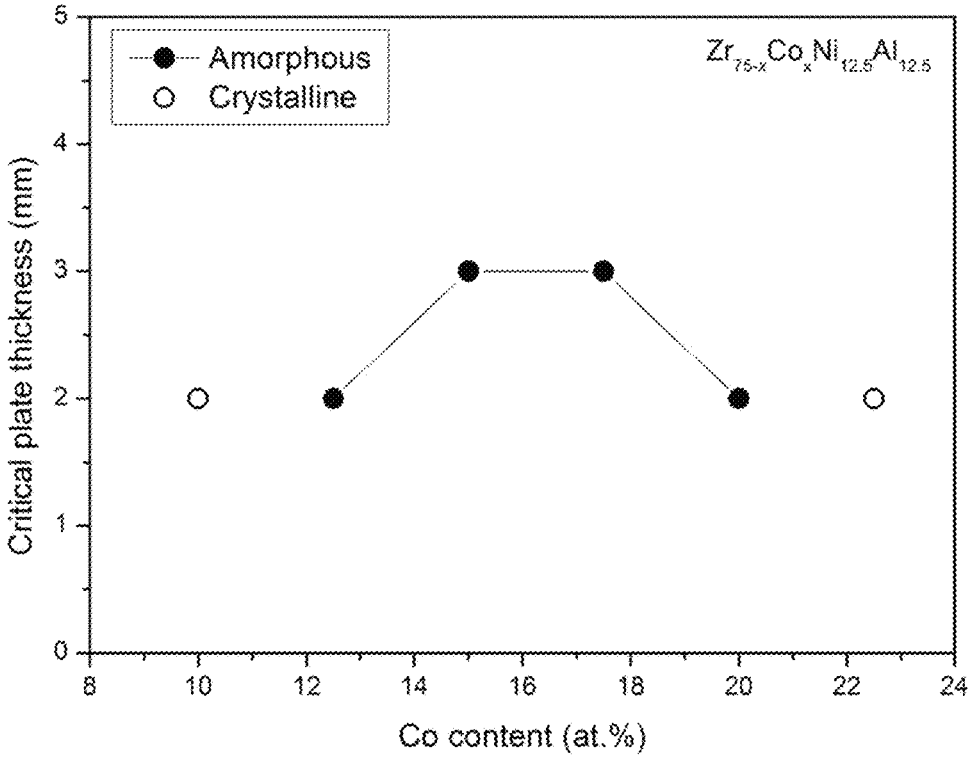
FIG. 8 provides a plot of the critical plate thickness of metallic glass-forming alloys according to composition formula $Zr_{75-x}Co_xNi_{12.5}Al_{12.5}$ in accordance with embodiments of the disclosure.

The critical plate thickness values of the example alloys according to the composition formula $Zr_{75-x}Co_xNi_{12.5}Al_{12.5}$ are listed in Table 5, and are plotted in FIG. 8. As shown in Table 5 and FIG. 8, substituting Zr by Co according to $Zr_{75-x}Co_xNi_{12.5}Al_{12.5}$ results in varying glass forming ability. Specifically, the critical plate thickness increases from less than 2 mm for the metallic glass-forming alloy containing 10 atomic percent Co (Example 7) to 2 mm for the metallic glass-forming alloy containing 12.5 atomic percent Co (Example 8), reaches the highest value of 3 mm for the metallic glass-forming alloys containing 15 and 17.5 atomic percent Co (Examples 9 and 3), and decreases back to 2 mm for the metallic glass-forming alloy containing 20 atomic percent Co (Example 10) and to less than 2 mm for the metallic glass-forming alloy containing 22.5 atomic percent Co (Example 11). Therefore, in the range where the Co content is greater than 7.5 and less than 22.5 atomic percent, the critical plate thickness of $Zr_{75-x}Co_xNi_{12.5}Al_{12.5}$ metallic glasses is at least 2 mm.

Figure 9:
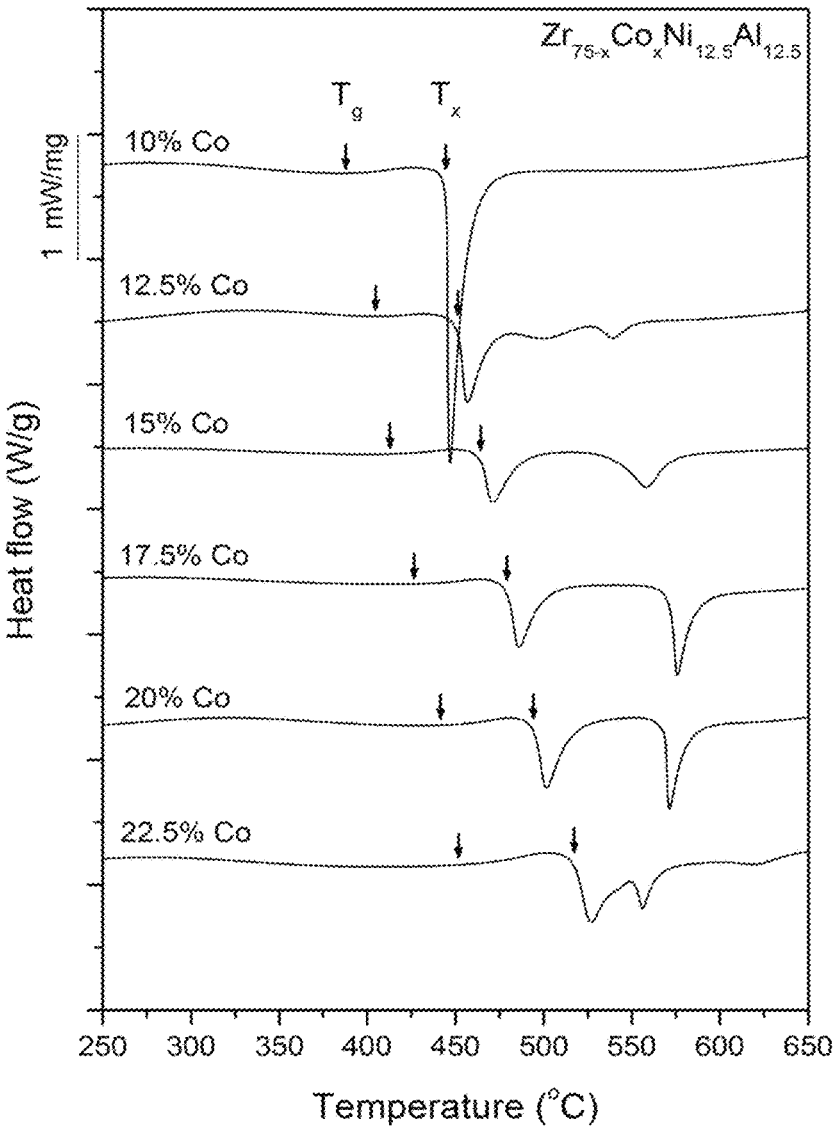
FIG. 9 provides calorimetry scans for sample metallic glasses according to $Zr_{75-x}Co_xNi_{12.5}Al_{12.5}$ in accordance with embodiments of the disclosure, where the glass transition temperature $T_g$ and crystallization temperature $T_x$ are indicated by arrows.

FIG. 9 provides calorimetry scans for sample metallic glasses according to the formula $Zr_{75-x}Co_xNi_{12.5}Al_{12.5}$ in accordance with embodiments of the disclosure. The glass transition temperature $T_g$ and crystallization temperature $T_x$ of the metallic glasses are indicated by arrows in FIG. 9, and are listed in Table 5.

Figure 10:
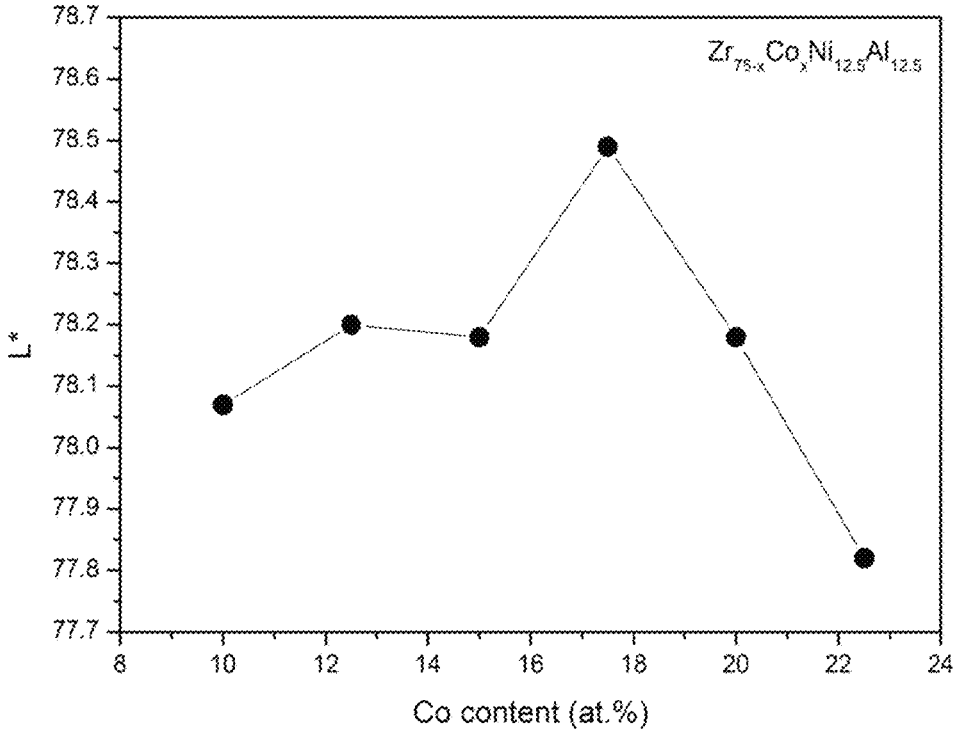
FIG. 10 provides a plot of the CIELAB L* (reflectivity) value of metallic glasses according to composition formula $Zr_{75-x}Co_xNi_{12.5}Al_{12.5}$ in accordance with embodiments of the disclosure.

The measured CIELAB color coordinates L*, a*, and b* of the example metallic glasses according to the composition formula $Zr_{75-x}Co_xNi_{12.5}Al_{12.5}$ are listed in Table 6. The CIELAB L* (reflectivity) values listed in Table 6 are plotted in FIG. 10. As shown in Table 6 and FIG. 10, substituting Zr by Co according to $Zr_{75-x}Co_xNi_{12.5}Al_{12.5}$ results in varying L*. Specifically, L* increases with increasing Co content from a low value of 78.07 for the metallic glass containing 10 atomic percent Co (Example 7), reaching a peak value of 78.49 for the metallic glass containing 17.5 atomic percent Co (Example 3), and then decreases back below 78 to the value of 77.82 for the metallic glass containing 22.5 atomic percent Co (Example 11). Therefore, in the range where the Co content is at least 10 atomic percent and less than 22.5 atomic percent, the reflectivity of $Zr_{75-x}Co_xNi_{12.5}Al_{12.5}$ metallic glasses is at least 78.

TABLE 6

Sample metallic glasses demonstrating the effect of increasing the Co atomic concentration at the expense of Zr according to the formula $Zr_{75-x}Co_xNi_{12.5}Al_{12.5}$ on the CIELAB color coordinates of the metallic glasses

| Example | Composition (at. %) | L* | a* | b* |
|---|---|---|---|---|
| 7 | $Zr_{65}Co_{10}Ni_{12.5}Al_{12.5}$ | 78.07 | 0.63 | 3.29 |
| 8 | $Zr_{62.5}Co_{12.5}Ni_{12.5}Al_{12.5}$ | 78.20 | 0.60 | 3.12 |
| 9 | $Zr_{60}Co_{15}Ni_{12.5}Al_{12.5}$ | 78.18 | 0.65 | 3.31 |
| 3 | $Zr_{57.5}Co_{17.5}Ni_{12.5}Al_{12.5}$ | 78.49 | 0.61 | 3.04 |
| 10 | $Zr_{55}Co_{20}Ni_{12.5}Al_{12.5}$ | 78.18 | 0.62 | 3.09 |
| 11 | $Zr_{52.5}Co_{22.5}Ni_{12.5}Al_{12.5}$ | 77.82 | 0.69 | 3.50 |

Figure 11:
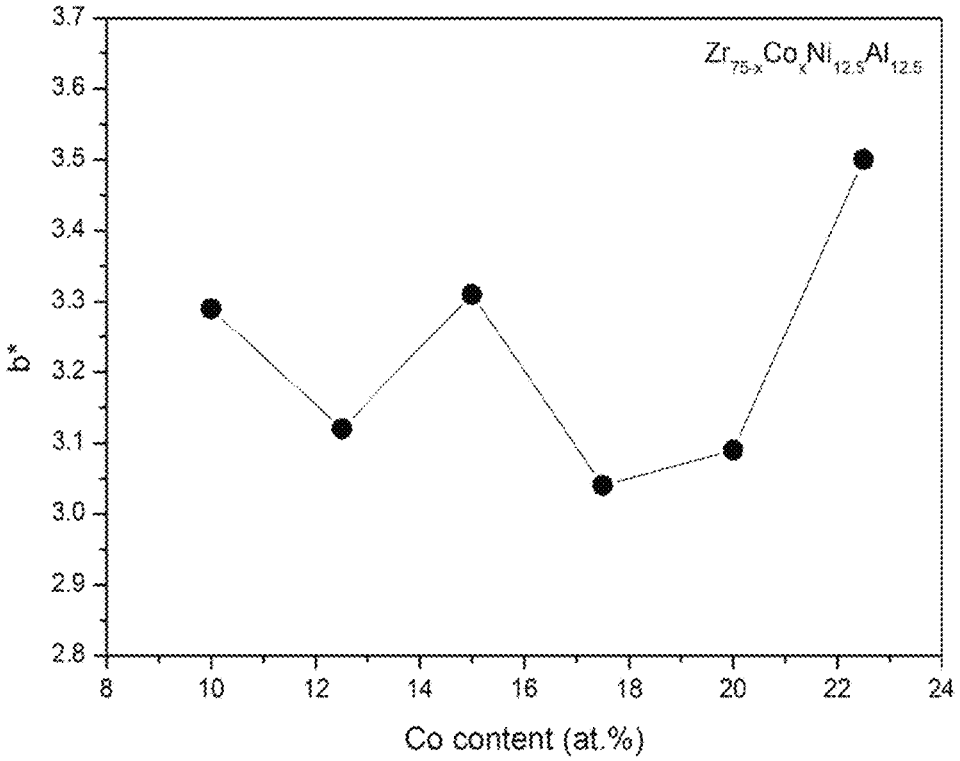
FIG. 11 provides a plot of the CIELAB b* value of metallic glasses according to composition formula $Zr_{75-x}Co_xNi_{12.5}Al_{12.5}$ in accordance with embodiments of the disclosure.

The CIELAB b* values of the example metallic glasses listed in Table 6 are plotted in FIG. 11. As shown in Table 6 and FIG. 11, in the range where the Co content varies between 10 and 20 atomic percent (Examples 3 and 7-10), the b* value of $Zr_{75-x}Co_xNi_{12.5}Al_{12.5}$ metallic glasses ranges between 3.04 and 3.31, and reaches 3.50 when the Co content is 22.5 atomic percent (Example 11). Lastly, the CIELAB a* value of $Zr_{75-x}Co_xNi_{12.5}Al_{12.5}$ metallic glasses is in the range of 0.6 to 0.69 when the Co content varies between 10 and 20 atomic percent.

Specific embodiments of metallic glasses formed of metallic glass-forming alloys with compositions according to the formula $Zr_{57.5}Co_{30-x}Ni_xAl_{12.5}$ are presented in Table 7. In these alloys, Ni is varied at the expense Co, where the atomic fraction of Ni increases from 7.5 to 20 percent as the atomic fraction of Co decreases from 22.5 to 10 percent, while the atomic fractions of Zr and Al are fixed at 57.5 and 12.5 percent, respectively.

TABLE 7

Sample metallic glasses demonstrating the effect of increasing the Ni atomic concentration at the expense of Co according to the formula $Zr_{57.5}Co_{30-x}Ni_xAl_{12.5}$ on the glass forming ability, glass-transition temperature and crystallization temperature

| Example | Composition | Critical Plate Thickness [mm] | $T_g$ (° C.) | $T_x$ (° C.) |
|---|---|---|---|---|
| 12 | $Zr_{57.5}Co_{22.5}Ni_{7.5}Al_{12.5}$ | <2 | 427.8 | 481.7 |
| 13 | $Zr_{57.5}Co_{20}Ni_{10}Al_{12.5}$ | 2 | 424.1 | 478.3 |
| 3 | $Zr_{57.5}Co_{17.5}Ni_{12.5}Al_{12.5}$ | 3 | 426.6 | 479.2 |
| 14 | $Zr_{57.5}Co_{15}Ni_{15}Al_{12.5}$ | 3 | 422.5 | 476.8 |
| 15 | $Zr_{57.5}Co_{12.5}Ni_{17.5}Al_{12.5}$ | 2 | 426.7 | 476.9 |
| 16 | $Zr_{57.5}Co_{10}Ni_{20}Al_{12.5}$ | <2 | 419.8 | 477.2 |

Figure 12:
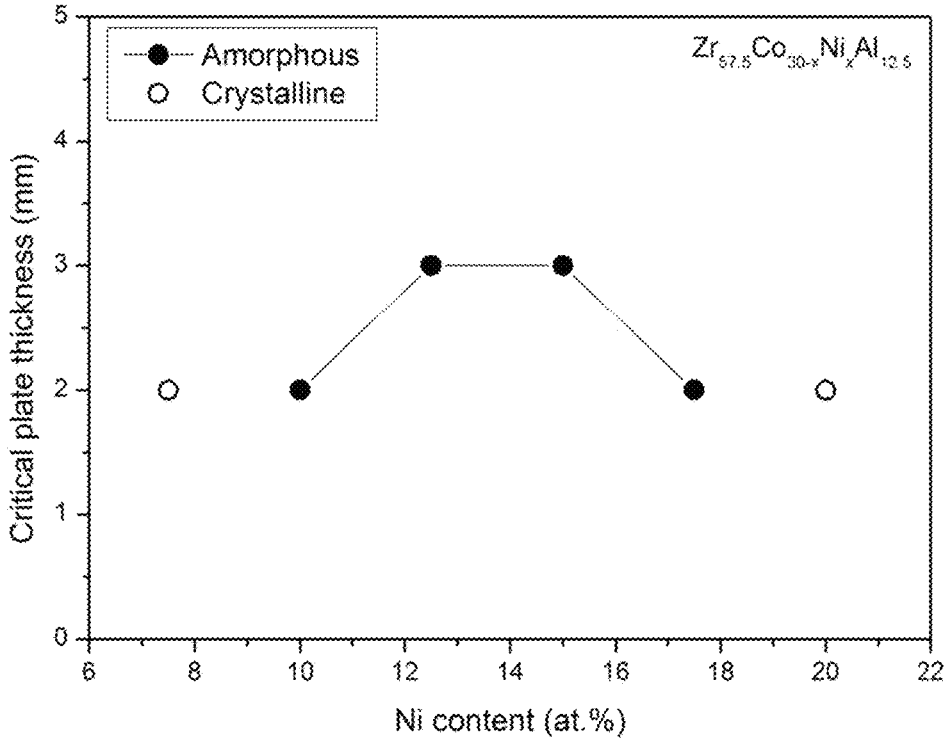
FIG. 12 provides a plot of the critical plate thickness of metallic glass-forming alloys according to composition formula $Zr_{57.5}Co_{30-x}Ni_xAl_{12.5}$ in accordance with embodiments of the disclosure.

The critical plate thicknesses values of the example alloys according to the composition formula $Zr_{57.5}Co_{30-x}Ni_xAl_{12.5}$ are listed in Table 7, and are plotted in FIG. 12. As shown in Table 7 and FIG. 12, substituting Co by Ni according to $Zr_{57.5}Co_{30-x}Ni_xAl_{12.5}$ results in varying glass forming ability. Specifically, the critical plate thickness increases from less than 2 mm for the metallic glass-forming alloy containing 7.5 atomic percent Ni (Example 12) to 2 mm for the metallic glass-forming alloy containing 10 atomic percent Ni (Example 13), reaches the highest value of 3 mm for the metallic glass-forming alloys containing 12.5 and 15 atomic percent Ni (Examples 14 and 3), and decreases back to 2 mm for the metallic glass-forming alloy containing 17.5 atomic percent Ni (Example 15) and to less than 2 mm for the metallic glass-forming alloy containing 20 atomic percent Ni (Example 16). Therefore, in the range where the Ni content is greater than 7.5 and less than 20 atomic percent, the critical plate thickness of $Zr_{57.5}Co_{30-x}Ni_xAl_{12.5}$ metallic glasses is at least 2 mm.

Figure 13:
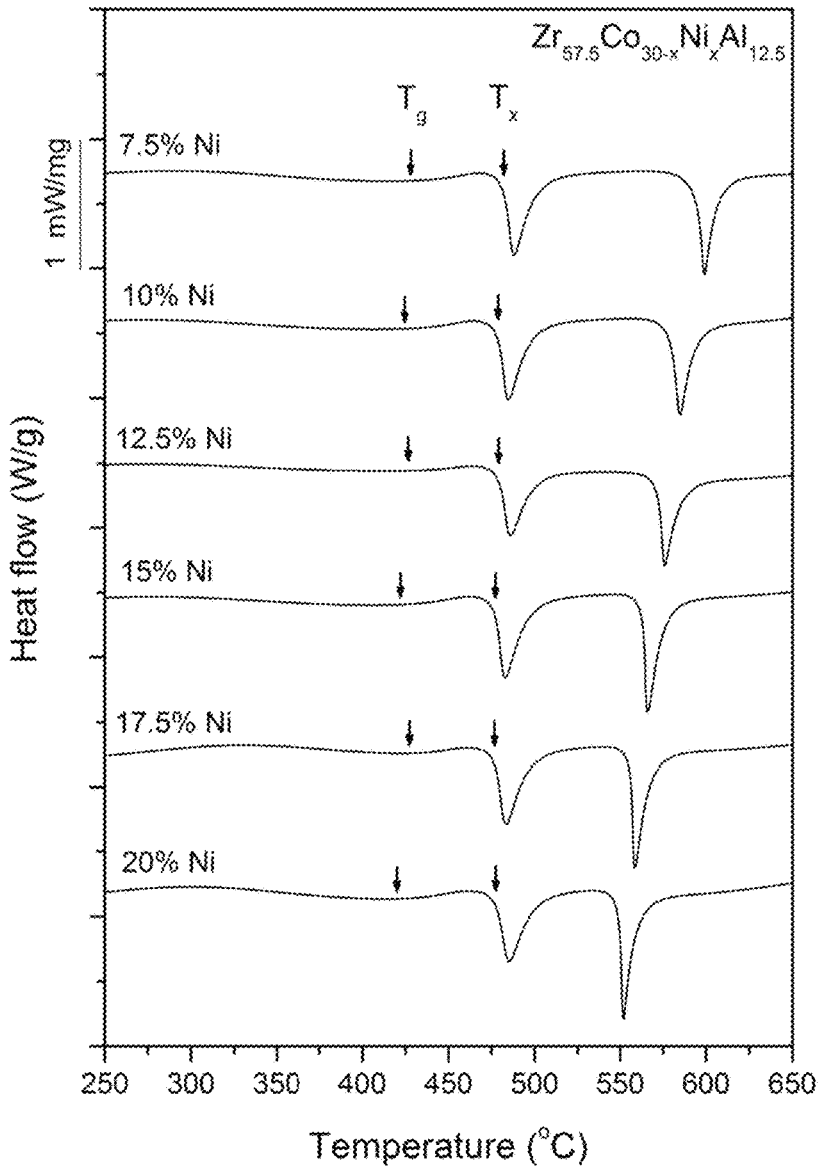
FIG. 13 provides calorimetry scans for sample metallic glasses according to $Zr_{57.5}Co_{30-x}Ni_xAl_{12.5}$ in accordance with embodiments of the disclosure, where the glass transition temperature $T_g$ and crystallization temperature $T_x$ are indicated by arrows.

FIG. 13 provides calorimetry scans for sample metallic glasses according to the formula $Zr_{557.5}Co_{30-x}Ni_xAl_{12.5}$ in accordance with embodiments of the disclosure. The glass transition temperature $T_g$ and crystallization temperature $T_x$ of the metallic glasses are indicated by arrows in FIG. 13, and are listed in Table 7.

Figure 14:
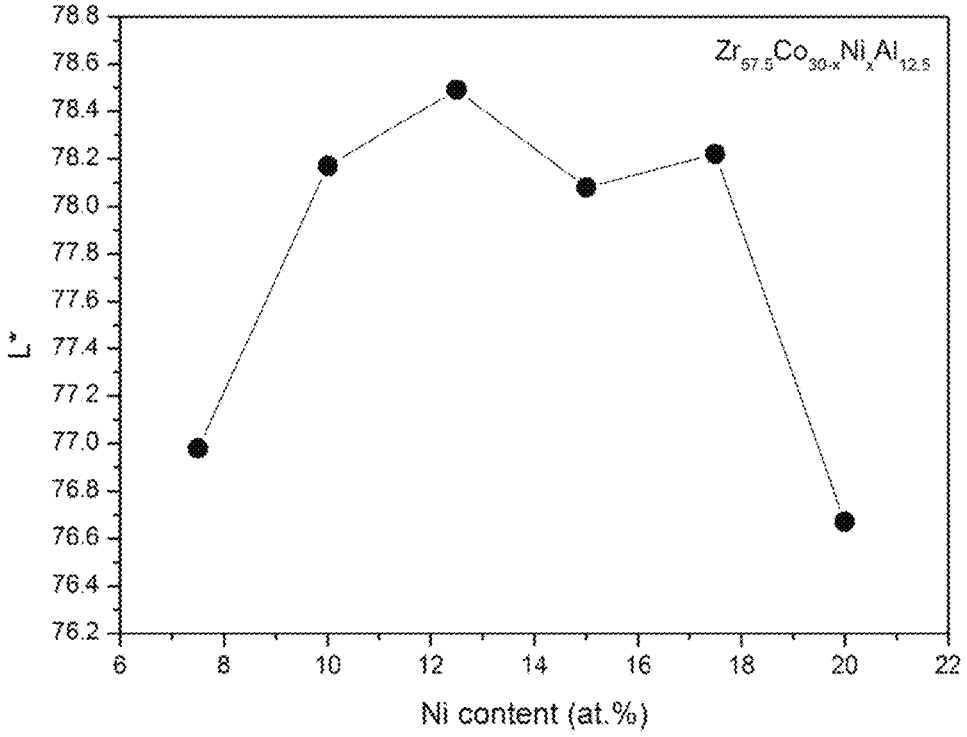
FIG. 14 provides a plot of the CIELAB L* (reflectivity) value of metallic glasses according to composition formula $Zr_{57.5}Co_{30-x}Ni_xAl_{12.5}$ in accordance with embodiments of the disclosure.

The measured CIELAB color coordinates L*, a*, and b* of the example metallic glasses according to the composition formula $Zr_{57.5}Co_{30-x}Ni_xAl_{12.5}$ are listed in Table 8. The CIELAB L* (reflectivity) values listed in Table 8 are plotted in FIG. 14. As shown in Table 8 and FIG. 14, substituting Co by Ni according to $Zr_{57.5}Co_{30-x}Ni_xAl_{12.5}$ results in varying L*. Specifically, L* is high (equal to or greater than 78) only within a narrow range of Ni content, and is low (less than 77) outside this optimum Ni content range. For the metallic glass containing 7.5 atomic percent Ni (Example 12), L* has a low value of 76.98. L* increases to above 78 with increasing Ni content beyond 7.5 atomic percent, reaching a value of 78.17 for the metallic glass containing 10 atomic percent Ni (Example 13). L* is above 78 for the metallic glasses containing 10, 12.5, 15, and 17.5 atomic percent Ni, varying between 78.08 and 78.49 (Examples 3, and 13-15). For the metallic glass containing 20 atomic percent Ni (Example 16), L* falls below 78 to a low value of 76.67. Therefore, in the range where the Ni content is greater than 7.5 atomic percent and less than 20 atomic percent, the reflectivity of $Zr_{57.5}Co_{30-x}Ni_xAl_{12.5}$ metallic glasses is at least 78.

TABLE 8

Sample metallic glasses demonstrating the effect of increasing the Ni atomic concentration at the expense of Co according to the formula $Zr_{57.5}Co_{30-x}Ni_xAl_{12.5}$ on the CIELAB color coordinates

| Example | Composition (at. %) | L* | a* | b* |
|---|---|---|---|---|
| 12 | $Zr_{57.5}Co_{22.5}Ni_{7.5}Al_{12.5}$ | 76.98 | 0.70 | 4.23 |
| 13 | $Zr_{57.5}Co_{20}Ni_{10}Al_{12.5}$ | 78.17 | 0.63 | 3.27 |
| 3 | $Zr_{57.5}Co_{17.5}Ni_{12.5}Al_{12.5}$ | 78.49 | 0.61 | 3.04 |
| 14 | $Zr_{57.5}Co_{15}Ni_{15}Al_{12.5}$ | 78.08 | 0.60 | 3.11 |
| 15 | $Zr_{57.5}Co_{12.5}Ni_{17.5}Al_{12.5}$ | 78.22 | 0.62 | 3.03 |
| 16 | $Zr_{57.5}Co_{10}Ni_{20}Al_{12.5}$ | 76.67 | 0.69 | 4.02 |

Figure 15:
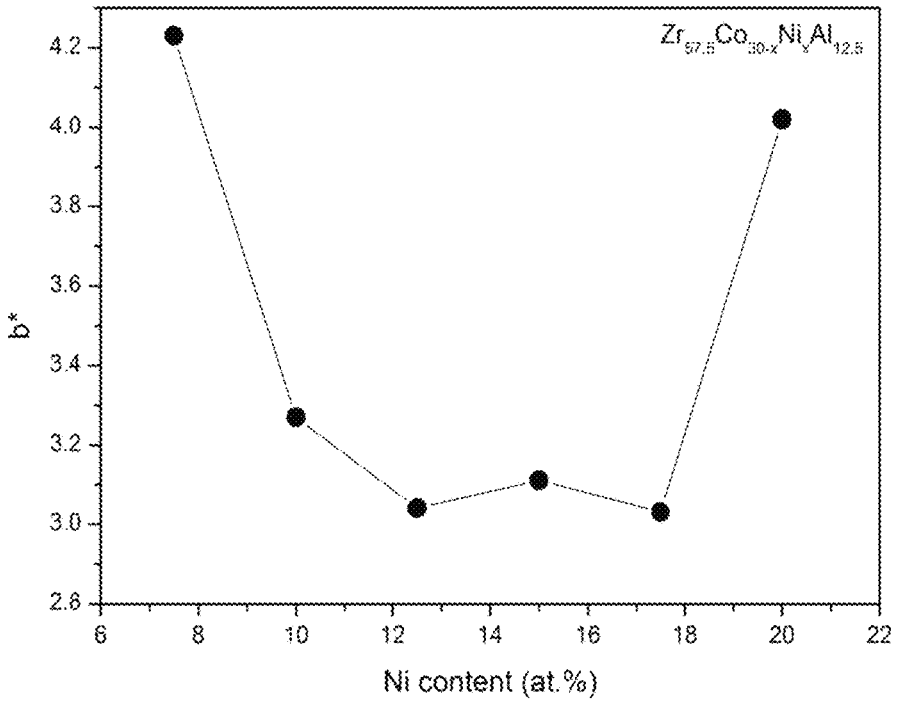
FIG. 15 provides a plot of the CIELAB b* value of metallic glasses according to composition formula $Zr_{57.5}Co_{30-x}Ni_xAl_{12.5}$ in accordance with embodiments of the disclosure.

The CIELAB b* values listed in Table 8 are plotted in FIG. 15. As shown in Table 8 and FIG. 15, substituting Co by Ni according to $Zr_{57.5}Co_{30-x}Ni_xAl_{12.5}$ results in varying b*. Specifically, b* is low (equal to or less than 3.5) only within a narrow range of Ni content, and is low (above 3.5) outside this optimum Ni content range. For the metallic glass containing 7.5 atomic percent Ni (Example 12), b* has a high value of 4.23. The value of b* decreases to below 3.5 with increasing Ni content beyond 7.5 atomic percent, reaching a value of 3.27 for the metallic glass containing 10 atomic percent Ni (Example 13). The value of b* is below 3.5 for the metallic glasses containing 10, 12.5, 15, and 17.5 atomic percent Ni, varying between 3.03 and 3.27 (Examples 3, and 13-15). For the metallic glass containing 20 atomic percent Ni (Example 16), b* rises above 3.5 to a high value of 4.02. Therefore, in the range where the Ni content is greater than 7.5 atomic percent and less than 20 atomic percent, the CIELAB b* value of $Zr_{57.5}Co_{30}Ni_xAl_{12.5}$ metallic glasses is equal to or less than 3.5. Lastly, the CIELAB a* value of $Zr_{57.5}Co_{30}$—$Ni_xAl_{12.5}$ metallic glasses is in the range of 0.60 to 0.71 when the Ni content varies between 7.5 and 20 atomic percent.

The disclosure is also directed to Zr—Co—Ni—Al alloys that optionally bear Ti. Specific embodiments of metallic glasses formed of metallic glass-forming alloys with compositions according to the formula $Zr_{57.5-x}Ti_xCo_{17.5}Ni_{12.5}Al_{12.5}$ are presented in Table 9. In these alloys, Ti is added at the expense Zr, where the atomic fraction of added Ti is up to 7 percent as the atomic fraction of Zr decreases from 57.5 to 50.5 percent, while the atomic fraction of Co is at 17.5 percent and the atomic fractions of Ni and Al are both fixed at 12.5 percent.

TABLE 9

Sample metallic glasses demonstrating the effect of increasing the Ti atomic concentration at the expense of Zr according to the formula $Zr_{57.5-x}Ti_xCo_{17.5}Ni_{12.5}Al_{12.5}$ on the glass forming ability, glass-transition temperature and crystallization temperature

| Example | Composition | Critical Plate Thickness [mm] | $T_g$ (° C.) | $T_x$ (° C.) |
|---|---|---|---|---|
| 3 | $Zr_{57.5}Co_{17.5}Ni_{12.5}Al_{12.5}$ | 3 | 426.6 | 479.2 |
| 17 | $Zr_{56.5}Ti_1Co_{17.5}Ni_{12.5}Al_{12.5}$ | 4 | 432.7 | 478.3 |
| 18 | $Zr_{55.5}Ti_2Co_{17.5}Ni_{12.5}Al_{12.5}$ | 5 | 431.6 | 481.5 |
| 19 | $Zr_{54.5}Ti_3Co_{17.5}Ni_{12.5}Al_{12.5}$ | 6 | 430.4 | 482.1 |
| 20 | $Zr_{53.5}Ti_4Co_{17.5}Ni_{12.5}Al_{12.5}$ | 6 | 433.5 | 482.7 |
| 21 | $Zr_{53}Ti_{4.5}Co_{17.5}Ni_{12.5}Al_{12.5}$ | 6 | 425.0 | 480.5 |
| 22 | $Zr_{52.5}Ti_5Co_{17.5}Ni_{12.5}Al_{12.5}$ | 6 | 428.2 | 481.2 |
| 23 | $Zr_{51.5}Ti_6Co_{17.5}Ni_{12.5}Al_{12.5}$ | 5 | 430.2 | 482.8 |
| 24 | $Zr_{50.5}Ti_7Co_{17.5}Ni_{12.5}Al_{12.5}$ | 4 | 426.2 | 479.7 |

Figure 16:
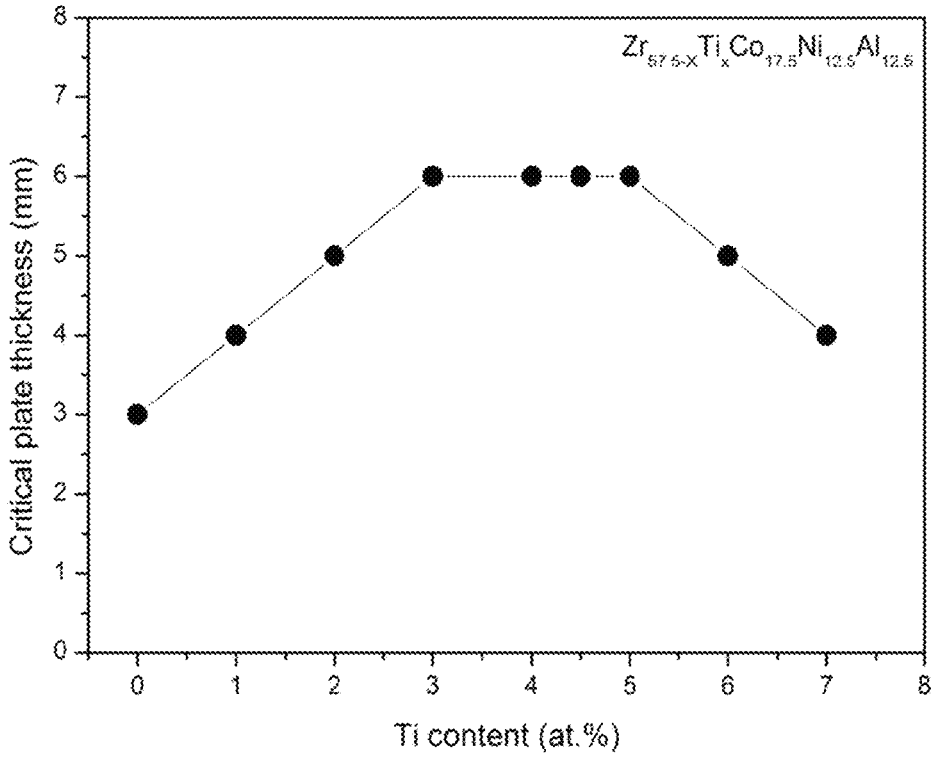
FIG. 16 provides a plot of the critical plate thickness of metallic glass-forming alloys according to composition formula $Zr_{57.5-x}Ti_xCo_{17.5}Ni_{12.5}Al_{12.5}$ in accordance with embodiments of the disclosure.

The critical plate thicknesses values of the example alloys according to the composition formula $Zr_{57.5-x}Ti_xCo_{17.5}Ni_{12.5}Al_{12.5}$ are listed in Table 9, and are plotted in FIG. 16. As shown in Table 9 and FIG. 16, substituting Zr by Ti according to $Zr_{57.5-x}Ti_xCo_{17.5}Ni_{12.5}Al_{12.5}$, where up to 7 atomic percent of Zr is substituted by Ti, results in improved glass forming ability. Specifically, the critical plate thickness increases from 3 mm for the metallic glass-forming alloy that is free of Ti (Example 3) to 6 mm for the metallic glass-forming alloy containing Ti in an atomic fraction between 3 and 5 atomic percent Ti (Examples 19-22), and decreases back to 4 mm for the metallic glass-forming alloy containing 7 atomic percent Ti (Example 24). Therefore, alloys according to embodiments of the invention that comprise Ti in a range of up to 7 atomic percent or greater (i.e. from 0.1 to 7 atomic percent, or from 0.25 to 7 atomic percent, or from 0.5 to 7 atomic percent) and in some embodiments up to 10 atomic percent (i.e. from 0.1 to 10 atomic percent, or from 0.25 to 10 atomic percent, or from 0.5 to 10 atomic percent), have a critical plate thickness of at least 3 mm. In some embodiments where the alloys comprise Ti in a range of 1 to 7 atomic percent, the critical plate thickness is at least 4 mm. In other embodiments where the alloys comprise Ti in a range of 2 to 6 atomic percent, the critical plate thickness is at least 5 mm.

Figure 17:
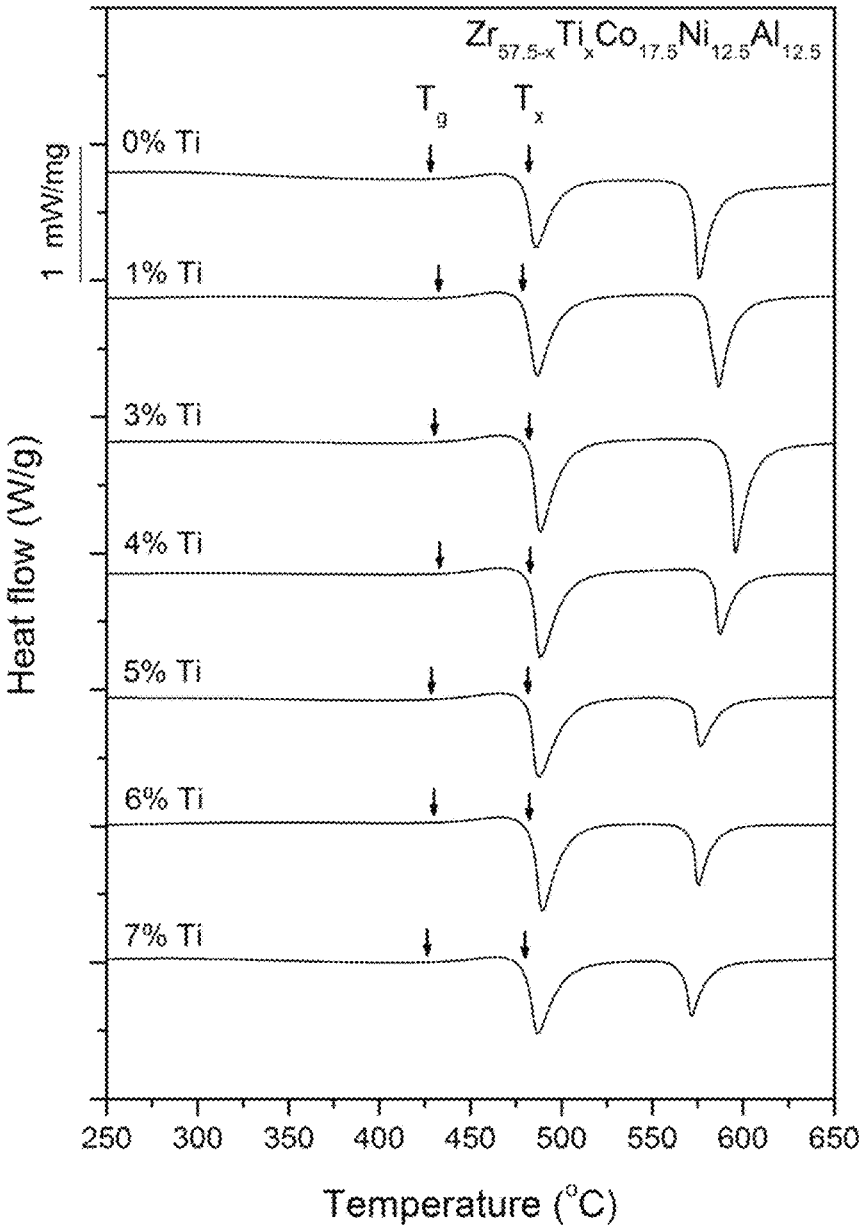
FIG. 17 provides calorimetry scans for sample metallic glasses according to $Zr_{57.5-x}Ti_xCo_{17.5}Ni_{12.5}Al_{12.5}$ in accordance with embodiments of the disclosure, where the glass transition temperature $T_g$ and crystallization temperature $T_x$ are indicated by arrows.

FIG. 17 provides calorimetry scans for sample metallic glasses according to the formula $Zr_{57.5-x}Ti_xCo_{17.5}Ni_{12.5}Al_{12.5}$ in accordance with embodiments of the disclosure. The glass transition temperature $T_g$ and crystallization temperature $T_x$ of the metallic glasses are indicated by arrows in FIG. 17, and are listed in Table 9.

Figure 18:
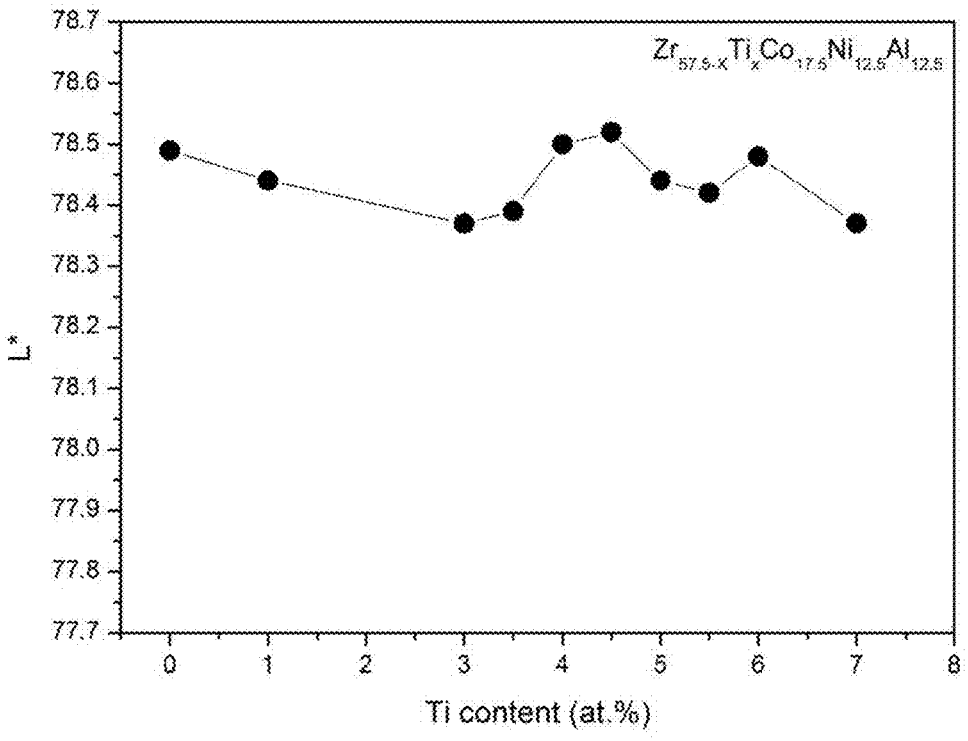
FIG. 18 provides a plot of the CIELAB L* (reflectivity) value of metallic glasses according to composition formula $Zr_{57.5-x}Ti_xCo_{17.5}Ni_{12.5}Al_{12.5}$ in accordance with embodiments of the disclosure.

The measured CIELAB color coordinates L*, a*, and b* of the example metallic glasses according to the composition formula $Zr_{57.5-x}Ti_xCo_{17.5}Ni_{12.5}Al_{12.5}$ are listed in Table 10. The CIELAB L* (reflectivity) values listed in Table 10 are plotted in FIG. 18. As shown in Table 10 and FIG. 18, substituting Zr by Ti according to $Zr_{57.5-x}Ti_xCo_{17.5}Ni_{12.5}Al_{12.5}$ results in a CIELAB L* value of greater than 78. Specifically, in the range of up to 7 atomic percent of Zr substitution by Ti, the CIELAB L* value is in the range of 78.37 to 78.52. Therefore, alloys according to embodiments of the invention that comprise Ti in a range of up to 7 atomic percent or greater, and in some embodiments up to 10 atomic percent, have a CIELAB L* value of at least 78.

TABLE 10

Sample metallic glasses demonstrating the effect of increasing the Ti atomic concentration at the expense of Zr according to the formula $Zr_{57.5-x}Ti_xCo_{17.5}Ni_{12.5}Al_{12.5}$ on the CIELAB color coordinates of the metallic glasses

| Example | Composition (at. %) | L* | a* | b* |
|---|---|---|---|---|
| 3 | $Zr_{57.5}Co_{17.5}Ni_{12.5}Al_{12.5}$ | 78.49 | 0.61 | 3.04 |
| 17 | $Zr_{56.5}Ti_1Co_{17.5}Ni_{12.5}Al_{12.5}$ | 78.44 | 0.61 | 3.06 |
| 19 | $Zr_{54.5}Ti_3Co_{17.5}Ni_{12.5}Al_{12.5}$ | 78.37 | 0.60 | 3.02 |
| 25 | $Zr_{54}Ti_{3.5}Co_{17.5}Ni_{12.5}Al_{12.5}$ | 78.39 | 0.58 | 2.98 |
| 20 | $Zr_{53.5}Ti_4Co_{17.5}Ni_{12.5}Al_{12.5}$ | 78.50 | 0.58 | 2.93 |
| 21 | $Zr_{53}Ti_{4.5}Co_{17.5}Ni_{12.5}Al_{12.5}$ | 78.52 | 0.57 | 2.88 |
| 22 | $Zr_{52.5}Ti_5Co_{17.5}Ni_{12.5}Al_{12.5}$ | 78.44 | 0.60 | 2.91 |
| 26 | $Zr_{52}Ti_{5.5}Co_{17.5}Ni_{12.5}Al_{12.5}$ | 78.42 | 0.57 | 2.89 |
| 23 | $Zr_{51.5}Ti_6Co_{17.5}Ni_{12.5}Al_{12.5}$ | 78.48 | 0.57 | 2.89 |
| 24 | $Zr_{50.5}Ti_7Co_{17.5}Ni_{12.5}Al_{12.5}$ | 78.37 | 0.58 | 2.97 |

Figure 19:
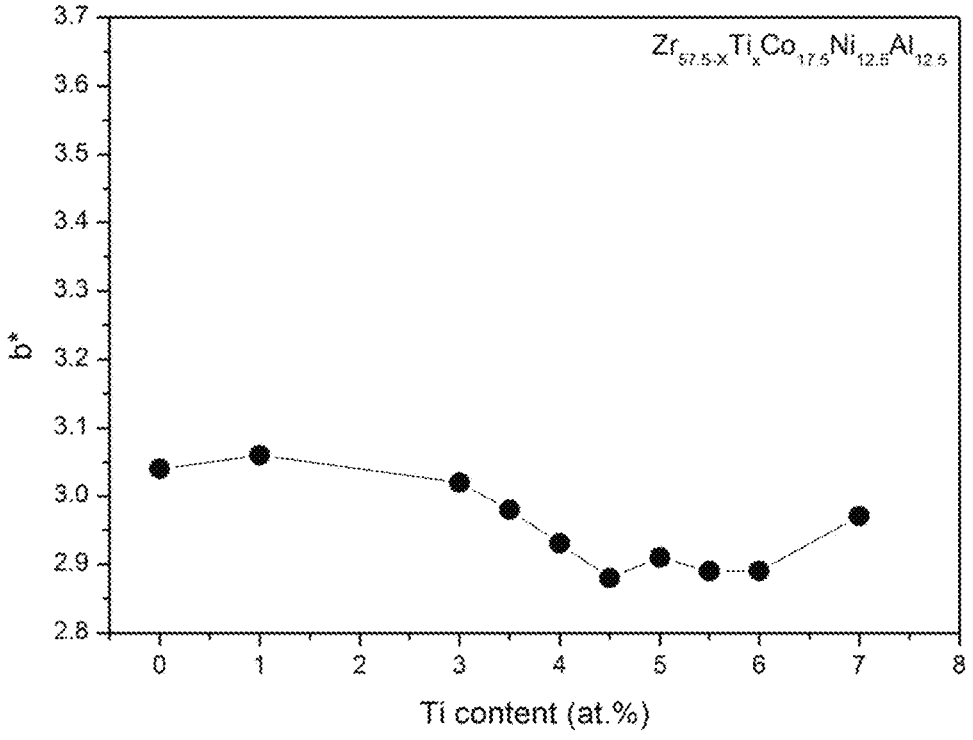
FIG. 19 provides a plot of the CIELAB b* value of metallic glasses according to composition formula $Zr_{57.5-x}Ti_xCo_{17.5}Ni_{2.5}Al_{12.5}$ in accordance with embodiments of the disclosure.

The CIELAB b* values of the example metallic glasses listed in Table 10 are plotted in FIG. 19. As shown in Table 10 and FIG. 19, substituting Zr by Ti according to $Zr_{57.5-x}Ti_xCo_{17.5}Ni_{12.5}Al_{12.5}$ in a range of up to 7 atomic percent results in a CIELAB L* value of less than 3.1. Specifically, in the range of up to 7 atomic percent of Zr substitution by Ti, the CIELAB b* value is in the range of 2.89 to 3.06. Therefore, alloys according to embodiments of the invention that comprise Ti in a range of up to 7 atomic percent or greater, and in some embodiments up to 10 atomic percent, have a CIELAB b* value of equal to or less than 3.5. Lastly, the CIELAB a* value of $Zr_{57.5-x}Ti_xCo_{17.5}Ni_{12.5}Al_{12.5}$ metallic glasses is in the range of 0.57 to 0.61 in the range of up to 7 atomic percent of Zr substitution by Ti.

Figure 20:
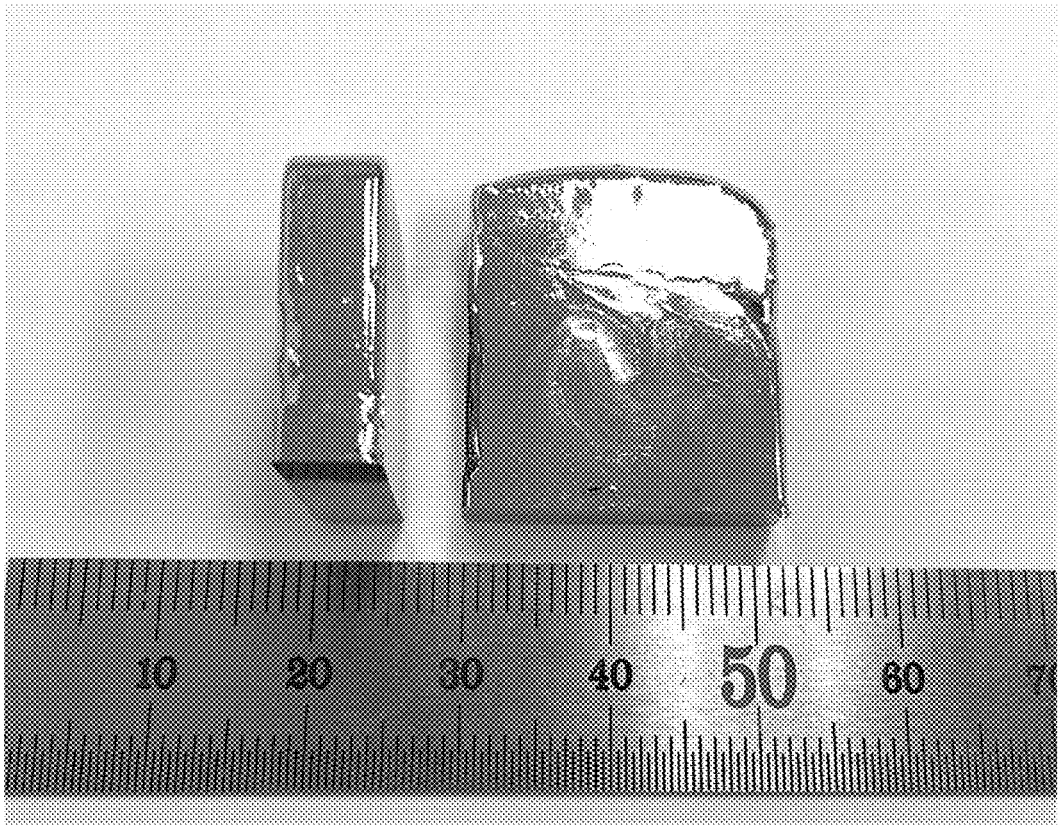
FIG. 20 presents a photograph of a 6 mm plate of metallic glass $Zr_{53}Ti_{4.5}Co_{17.5}Ni_{12.5}Al_{12.5}$, in accordance with embodiments of the disclosure.
Figure 21:
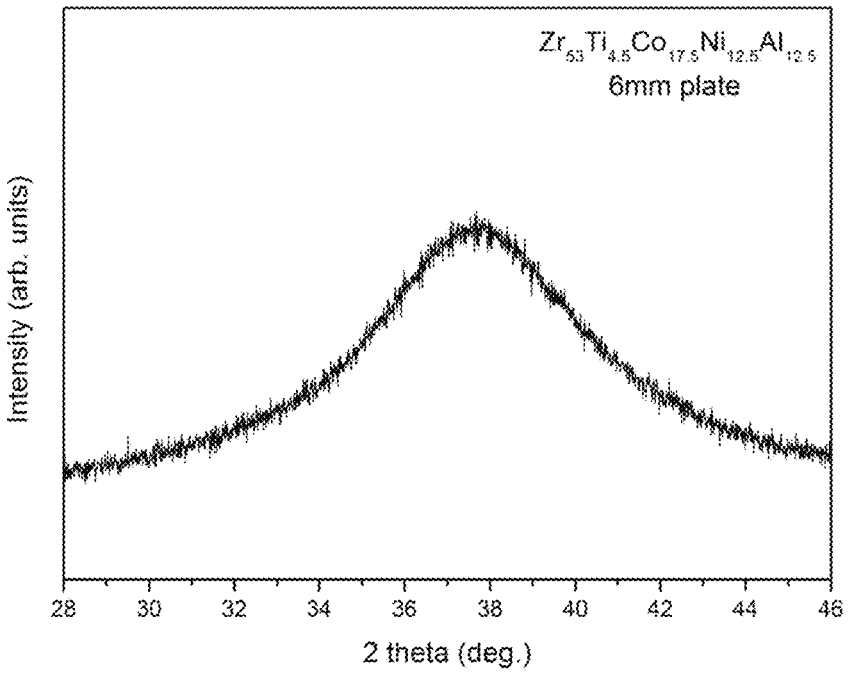
FIG. 21 presents an x-ray diffractogram of a 6 mm plate of metallic glass $Zr_{53}Ti_{4.5}Co_{17.5}Ni_{12.5}Al_{12.5}$, in accordance with embodiments of the disclosure.
Figure 22:
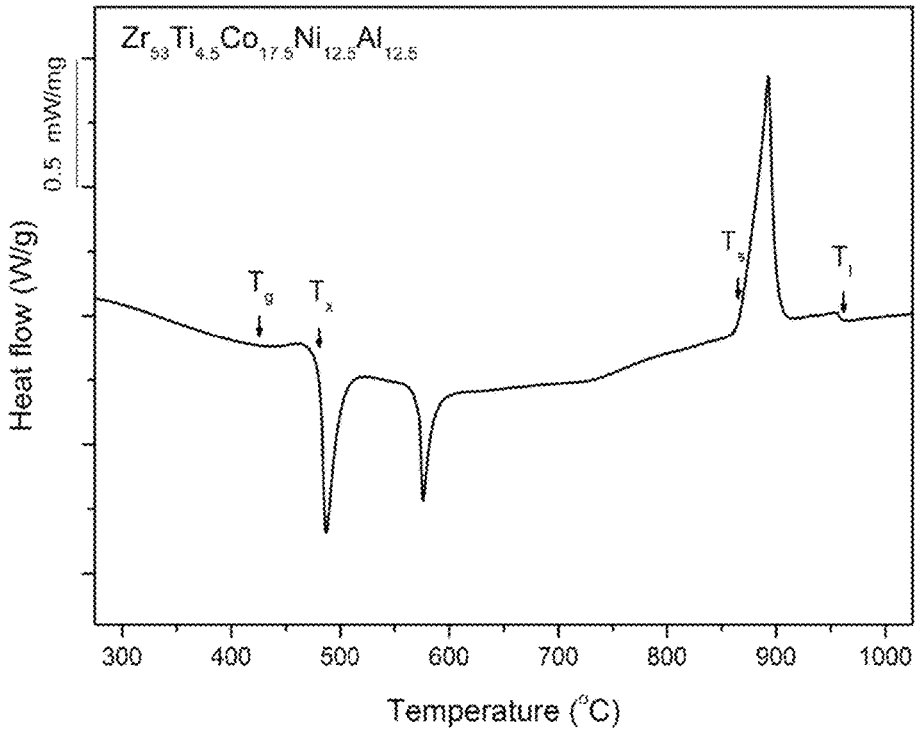
FIG. 22 provides a calorimetry scan for metallic glass $Zr_{53}Ti_{4.5}Co_{17.5}Ni_{12.5}Al_{12.5}$, in accordance with embodiments of the disclosure, where the glass transition temperature $T_g$, crystallization temperature $T_x$, solidus temperature $T_s$, and liquidus temperature $T_l$, are indicated by arrows.

FIG. 20 presents a photograph of a 6 mm plate of metallic glass $Zr_{53}Ti_{4.5}Co_{17.5}Ni_{12.5}Al_{12.5}$ (Example 21). FIG. 21 presents an x-ray diffractogram of a 6 mm plate of metallic glass $Zr_{53}Ti_{4.5}Co_{17.5}Ni_{12.5}Al_{12.5}$ (Example 21) verifying the amorphous structure of the plate. FIG. 22 provides a calorimetry scan for metallic glass $Zr_{53}Ti_{4.5}Co_{17.5}Ni_{12.5}Al_{12.5}$ (Example 21). The glass transition temperature $T_g$, crystallization temperature $T_x$, solidus temperature $T_s$ of 865.5° C., and liquidus temperature T of 961.4° C., are indicated by arrows in FIG. 22.

Methods of Processing the Alloy Ingots of the Sample Metallic Glass-Forming Alloys A particular method for producing alloy ingots for the sample metallic glass-forming alloys involves arc melting of the appropriate amounts of elemental constituents over a water-cooled copper hearth under a titanium-gettered argon atmosphere. The purity levels of the constituent elements were as follows: Zr 99.9% (crystal bar), Ti 99.9% (crystal bar), Co 99.995%, Ni 99.995%, and Al 99.999%. The argon atmosphere was created by first establishing vacuum at $1.5\times10^{-4}$ mbar, followed by a purge of ultra-high purity argon gas (99.999% purity) to establish a pressure of 800 mbar.

Methods of Processing the Sample Metallic Glass Plates

A particular method for producing metallic glass plates from the metallic glass-forming alloy ingots for the sample metallic glass-forming alloys involves melting the alloy ingots over a water-cooled copper hearth under a titanium-gettered argon atmosphere to form an alloy melt, heating the alloy melt to a temperature of at least 1200° C., and subsequently pouring the alloy melt into a copper mold. Copper molds having a prismatic cavity with length of 55 mm, width of 22 mm, and varying thickness were used. The argon atmosphere was created by first establishing vacuum at $1.5\times10^{-4}$ mbar, followed by a purge of ultra-high purity argon gas (99.999% purity) to establish a pressure of 800 mbar.

Method for Measuring the CIELAB Color Coordinates

The CIELAB color coordinates were measured using a Konica Minolta CM-700d spectrophotometer with an aperture size of 8 mm on 20 mm×20 mm metallic glass plate coupons polished to a 1 μm diamond mirror finish. Measurements were performed at each of the four corners of the plate coupons and averaged.

Method for Performing Differential Scanning Calorimetry

Differential scanning calorimetry was performed on sample metallic glasses at a scan rate of 20 K/min to determine the glass-transition, crystallization, solidus, and liquidus temperatures of sample metallic glasses.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An alloy capable of forming a metallic glass having a composition represented by the following formula:

$$Zr_{(100-a-b-c-d)}Ti_aCo_bNi_cAl_d$$

where:

a is up to 10;

b ranges from 12 to 22;

c ranges from 8 to 20; and d ranges from 8 to 18, wherein the critical plate thickness of the alloy is at least 2 mm, and wherein the CIELAB L* value of the metallic glass is at least 78.

2. The alloy of claim 1, wherein the CIELAB b* value of the metallic glass is equal to or less than 3.5.

3. The alloy of claim 1, wherein the notch toughness of the metallic glass is at least 70 MPa $m^{1/2}$.

4. The alloy of claim 1, wherein a ranges from 0.1 to 10, and the critical plate thickness is at least 3 mm.

5. The alloy of claim 1, wherein a ranges from 1 to 7, and the critical plate thickness of the alloy is at least 4 mm.

6. The alloy of claim 1, wherein a ranges from 2 to 6, and the critical plate thickness of the alloy is at least 5 mm.

7. The alloy of claim 1, wherein b ranges from 14 to 20, and the CIERLAB L* value of the metallic glass is at least 78.2.

8. The alloy of claim 1, wherein c ranges from 10.25 to 17.25, and the critical plate thickness of the alloy is greater than 2 mm.

9. The alloy of claim 1, wherein c ranges from 9.5 to 18, and the CIELAB b* value of the metallic glass is less than 3.25.

10. The alloy of claim 1, wherein c ranges from 10.25 to 14.75, and the CIELAB L* value of the metallic glass is greater than 78.2.

11. The alloy of claim 1, wherein d ranges from greater than 10 to less than 17.5, and the critical plate thickness of the alloy is greater than 2 mm.

12. The alloy of claim 1, wherein d ranges from 8 to less than 17.5, and the CIELAB L* value of the metallic glass is greater than 78.

13. The alloy of claim 1, wherein d ranges from 8 to 16, and the CIELAB L* value of the metallic glass is greater than 78.2.

14. The alloy of claim 1, wherein d ranges from 8 to 16, and the notch toughness of the metallic glass is at least 70 MPa $m^{1/2}$.

15. The alloy of claim 1, wherein d ranges from 8 to less than 15, and the CIELAB L* value of the metallic glass is greater than 78.4.

16. The alloy of claim 1, wherein d ranges from 10 to 15.5, and the notch toughness of the metallic glass is at least 90 MPa $m^{1/2}$.

17. The alloy of claim 1, wherein the alloy additionally comprises Nb in an atomic concentration of up to 2% subtracted from either the atomic concentration of Zr or a.

18. The alloy of claim 1, wherein the alloy additionally comprises at least one of Ag, Pd, Pt, and Fe in a combined atomic concentration of up to 2% subtracted from either b or c.

19. The alloy of claim 1, wherein the alloy additionally comprises at least one of Sn, Si, Ge, B and Be in a combined atomic concentration of up to 2% subtracted from d.

* * * * *